US010731803B2

(12) United States Patent
Van Winkle

(10) Patent No.: US 10,731,803 B2
(45) Date of Patent: Aug. 4, 2020

(54) LINKABLE LED STRIP LIGHTING FIXTURE

(71) Applicant: ETi Solid State Lighting Inc., Wheeling, IL (US)

(72) Inventor: Gary Van Winkle, Chagrin Falls, OH (US)

(73) Assignee: ETi Solid State Lighting Inc., Wheeling, IL (US)

( * ) Notice: Subject to any disclaimer, the term of this patent is extended or adjusted under 35 U.S.C. 154(b) by 0 days.

(21) Appl. No.: 16/423,536

(22) Filed: May 28, 2019

(65) Prior Publication Data

US 2019/0277460 A1 Sep. 12, 2019

Related U.S. Application Data

(60) Division of application No. 15/703,153, filed on Sep. 13, 2017, now Pat. No. 10,352,510, which is a (Continued)

(51) Int. Cl.
*F21S 4/20* (2016.01)
*F21V 15/01* (2006.01)
(Continued)

(52) U.S. Cl.
CPC . *F21S 4/20* (2016.01); *F21S 2/00* (2013.01); *F21S 4/10* (2016.01); *F21S 4/28* (2016.01);
(Continued)

(58) Field of Classification Search
CPC ..... F21S 4/20; F21S 8/061; F21S 2/00; F21S 4/28; F21S 4/10; F21V 23/001;
(Continued)

(56) References Cited

U.S. PATENT DOCUMENTS 2,567,014 A 9/1951 Fine et al.
4,484,791 A * 11/1984 Johnson ..... H01R 12/675 439/404
(Continued)

FOREIGN PATENT DOCUMENTS

CN 201973532 U 9/2011
CN 202165832 U * 3/2012
CN 202521318 U 11/2012

OTHER PUBLICATIONS

Machine English Translation of CN2021658322; Fan (Year: 2012).*
(Continued)

*Primary Examiner* — Isiaka O Akanbi
*Assistant Examiner* — Glenn D Zimmerman
(74) *Attorney, Agent, or Firm* — Walter | Haverfield LLP; D Peter Hochberg; Sean F. Mellino

(57) ABSTRACT

An elongated, linkable LED strip lighting fixture having an elongated LED strip light engine with an LED light engine electrical contacting structure for cooperating with a linking device to link elongated, linkable LED strip lighting fixtures together, the linked LED lighting fixtures are powered by a single connection to an electrical outlet. The linked LED strip lighting fixtures can be operated independently of each other. A linking device is also included, and a patch plug is provided for enabling the linking plug to be operatively connected to an electrical output.

16 Claims, 18 Drawing Sheets

Related U.S. Application Data continuation-in-part of application No. 14/981,346, filed on Dec. 28, 2015, now Pat. No. 10,465,896.

(51) Int. Cl.

| | |
|---|---|
| ***F21S 4/10*** | (2016.01) |
| ***F21S 2/00*** | (2016.01) |
| ***F21S 8/06*** | (2006.01) |
| ***F21V 23/00*** | (2015.01) |
| ***F21V 23/04*** | (2006.01) |
| ***F21V 23/06*** | (2006.01) |
| ***F21V 29/70*** | (2015.01) |
| ***F21S 4/28*** | (2016.01) |
| *F21Y 103/10* | (2016.01) |
| *F21V 7/00* | (2006.01) |
| *F21W 131/40* | (2006.01) |
| *F21Y 115/10* | (2016.01) |

(52) U.S. Cl.

CPC ..... *F21S 8/061* (2013.01); *F21V 15/013* (2013.01); *F21V 23/001* (2013.01); *F21V 23/04* (2013.01); *F21V 23/06* (2013.01); *F21V 29/70* (2015.01); *F21V 7/005* (2013.01); *F21W 2131/40* (2013.01); *F21Y 2103/10* (2016.08); *F21Y 2115/10* (2016.08)

(58) Field of Classification Search

CPC ..... F21V 23/04; F21V 23/06; F21V 15/013; F21V 29/70; F21V 7/005; F21Y 2103/10; F21Y 2115/10; F21W 2131/40

See application file for complete search history.

(56) References Cited

U.S. PATENT DOCUMENTS

| | | | | |
|---|---|---|---|---|
| 5,848,837 | A | 12/1998 | Gustafson | |
| 6,283,612 | B1 | 9/2001 | Hunter | |
| 6,536,924 | B2 | 3/2003 | Segretto | |
| 6,860,628 | B2 | 3/2005 | Robertson et al. | |
| 6,936,968 | B2 | 8/2005 | Cross et al. | |
| 7,192,160 | B2 | 3/2007 | Reiff, Jr. et al. | |
| 7,213,938 | B2 | 5/2007 | Brondt et al. | |
| D571,500 | S * | 6/2008 | Lin | D26/139 |
| 7,438,441 | B2 | 10/2008 | Sun et al. | |
| 7,441,922 | B2 | 10/2008 | Huang et al. | |
| 7,476,004 | B2 | 1/2009 | Chan | |
| 7,513,640 | B2 | 4/2009 | Hendrikus | |
| 7,810,955 | B2 | 10/2010 | Stimac et al. | |
| 7,997,770 | B1 | 8/2011 | Meurer | |
| 8,308,324 | B2 | 11/2012 | Van Horn et al. | |
| 8,531,109 | B2 | 9/2013 | Visser et al. | |
| 8,714,772 | B1 | 5/2014 | Levante et al. | |
| 8,882,298 | B2 | 11/2014 | Gershaw | |
| 9,004,716 | B2 | 4/2015 | Ai | |
| 2002/0126064 | A1* | 9/2002 | Yen | G09F 9/33 345/5 |
| 2005/0041418 | A1* | 2/2005 | Fan | F21V 23/06 362/217.05 |
| 2006/0202850 | A1* | 9/2006 | Hefright | B60Q 1/2696 340/815.45 |
| 2007/0127244 | A1 | 6/2007 | Cunius | |
| 2008/0089069 | A1 | 4/2008 | Medendorp | |
| 2009/0021936 | A1 | 1/2009 | Stimac et al. | |
| 2009/0237922 | A1 | 9/2009 | Chiu | |
| 2009/0251919 | A1* | 10/2009 | Teeters | F21V 23/06 362/576 |
| 2009/0296381 | A1 | 12/2009 | Dubord | |
| 2010/0177511 | A1 | 7/2010 | Yu | |
| 2010/0284195 | A1 | 11/2010 | Liu et al. | |
| 2010/0295468 | A1 | 11/2010 | Pedersen et al. | |
| 2011/0156591 | A1* | 6/2011 | Lin | F21V 15/01 315/113 |
| 2012/0182755 | A1* | 7/2012 | Wildner | G09F 9/301 362/555 |
| 2012/0188756 | A1 | 7/2012 | Kokoski et al. | |
| 2012/0218746 | A1* | 8/2012 | Winton | H05B 33/0806 362/219 |
| 2012/0300441 | A1 | 11/2012 | Thomas et al. | |
| 2013/0182422 | A1 | 7/2013 | Guilmette | |
| 2013/0343050 | A1 | 12/2013 | Hu | |
| 2014/0043802 | A1* | 2/2014 | Dings | F21S 2/005 362/221 |
| 2014/0177209 | A1 | 6/2014 | Carney et al. | |
| 2014/0226320 | A1 | 8/2014 | Halliwell et al. | |
| 2014/0226321 | A1 | 8/2014 | Halliwell et al. | |
| 2014/0247585 | A1 | 9/2014 | Chien et al. | |
| 2014/0355272 | A1 | 12/2014 | Chou | |
| 2015/0115802 | A1* | 4/2015 | Kuti | F21V 15/01 315/149 |
| 2015/0138772 | A1* | 5/2015 | Hanslip | F21V 21/005 362/249.06 |
| 2016/0281956 | A1* | 9/2016 | Ji | F21V 5/007 |
| 2017/0276332 | A1* | 9/2017 | Pearson | F21V 21/005 |

OTHER PUBLICATIONS

Machine English Translation of CN201973532; Wang et al. (Year: 2011).*

Examiner's Report from the Canadian Intellectual Property Office dated Jan. 29, 2018 for related Canadian Application No. 2,960,058.

* cited by examiner

FIG−9

LINKABLE LED STRIP LIGHTING FIXTURE

CROSS-REFERENCE TO RELATED APPLICATION

This application is a divisional of U.S. patent application Ser. No. 15/703,153 which is a continuation-in-part of U.S. patent application Ser. No. 14/981,346 filed Dec. 28, 2015, which are incorporated herein by reference in their entireties.

BACKGROUND OF THE INVENTION

Field of the Invention

The present invention relates to linkable light emitting diode (LED) lighting fixtures and systems, and in particular to linkable LED strip lighting fixtures and systems.

Description of the Prior Art

There are many lighting fixtures which are used for a variety of purposes including workshops, offices, factories, residences, schools and the like, which until fairly recently the market for such fixtures was largely filled with incandescent bulbs and fluorescent lights. A big problem with incandescent bulbs is that they convert most of their energy into heat as opposed to light, thus wasting electricity and generating unnecessary warmth. Fluorescent lighting generally involves ionizing a gas such as argon contained within a sealed tube. The electrically-excited gas produces light emission as the gas returns to its normal energy level. Although fluorescent lighting is widely used, it does have serious shortcomings. Fluorescent lighting is rather complex, and repairs can be costly both with respect to replacing ballasts and other components which may have to be replaced from time to time, and with respect to the high voltage that is needed for fluorescent lighting. The high voltage makes necessary added electrical insulation, and the requirement for safety precautions.

Compact fluorescent light bulbs have also become popular. Compact fluorescent lights, or CFLs convert most of their energy into light rather than heat. CFLs last longer than incandescent lights and are designed to fit into existing incandescent lighting fixtures. CFLs use about ¼ of the electricity required for incandescent bulbs while producing a comparable amount of light. While CFLs do not flicker when used for an extended period of time, they do have flickering problems if switched on and off frequently. Furthermore, the switching process takes more time than is desirable so that CFLs take a longer time to light before they become fully lit. Furthermore, CFLs require optimum temperatures to work and are known to function in less than their rated capacity when switched on in lower temperatures.

LEDs are becoming more and more popular. LEDs require lower power consumption than do CFLs.

A single LED is very small, but a combination of bunches of LEDs create powerful lights which can withstand more extreme conditions than ordinary bulbs. LEDs use about 1/50 of the energy of the standard incandescent bulbs, and last ten times longer than CFL alternatives. Indeed, LED bulbs can last up to fifteen years without needing to be changed. LEDs furthermore produce smaller amounts of heat than do CFLs, and the heat which is produced by LEDs is usually past back to a heat sink making them cool to the touch. With respect to energy efficiency, whereas a CFL uses less than fifteen watts and costs about $75.00 per year, an LED bulb of similar output would draw less than eight watts of power with an annual cost of $30.00 and last 50,000 hours or more.

There is also a disposal problem with CFL bulbs. CFL bulbs contain mercury which can evaporate and cause air and water pollution. Furthermore, mercury is a neurotoxin that can have a harmful effect on humans, particularly infants. Thus, disposal of CFLs and regular fluorescent bulbs can be a problem since they may break and release the mercury. They can thus be a problem for landfills and waste management workers, in addition to the environmental problems noted above.

The danger of CFLs is severe. The Environmental Protection Agency (EPA) has approved CFL recycling sites. Furthermore, the EPA recommends that in case a CFL breaks in a home, all members and pets are recommended to leave the room. The room has to be aired out for 10-15 minutes, the central forced air should be shut off, and the shards should be collected with stiff paper, tape or a damp paper towel, and then put in a glass jar with a metal lid or a sealable plastic bag and then taken to a recycling site. On the other hand, LED bulbs do not come with a mercury hazard, and most of them are recyclable.

There are other comparisons which indicate that LED bulbs are preferable over CFLs. CFLs require time after actuation in order for them to warm up to full capacity, whereas LED bulbs do not require any length of time to become active. CFLs may not work in temperatures that are less than −10° F. or greater than 100° F. whereas LED bulbs are not temperature sensitive. CFLs are not dimmable, whereas LED bulbs are dimmable. Although LED bulbs cost more than CFLs, the total cost of LED bulbs is less than the cost of CFLs during the life of the LEDs.

Thus, LED bulbs and LED lighting fixtures have been becoming more and more popular over time. In many instances, a single LED lighting fixture may be sufficient for such uses as in workshops. However, oftentimes a number of LED lighting fixtures would be desirable. One could install a series of independent LED lighting fixtures which need to be turned on and off as needed. This could be expensive, and could require a number of receptacles provided along the area which is to be illuminated. This concept has been addressed previously, but there are various shortcomings. Referring to U.S. Pat. No. 7,192,160, a set of fluorescent and/or LED light sources is shown having a control box for switching between two light sources is discussed. A series of lights can be electrically linked in series, and each light is provided with a control box so that the individual lights can be individually operated. This can be used in military barracks, wherein each soldier would be able to control his own light. However, this embodiment requires a series of control boxes, making the system expensive. Alternatively, the string of lights can have one control box in which all of the lights are operated in series. The first light in the series of lights is the master and the remaining lights that are connected are slave lights. Thus, all of the lights must be operated together, rather than one at a time.

Another light tube system is disclosed in U.S. Pat. No. 7,513,640. Light tube system can have a number of light tube units which are connected together by cables. The cables have connector pins which extend in a direction perpendicular to the longitudinal direction of the light tubes, making it awkward to connect them together. There is no indication in the '640 patent as to where the on-off switch is located. The light tubes discussed in this patent appear to be fluorescent tubes, and thus have all of the shortcomings of fluorescent bulbs discussed above.

In U.S. Pat. No. 9,004,716, a set of LED tubes are connected together by adaptors so that the tubes extend in a collinear direction. The adaptors include an adaptor main body and rotational fittings. A shortcoming of the disclosure of this patent is that the LED tubes must be fixed in a certain position, and no variation of the position is possible. There is also no device for hanging the assemblies at their opposite ends.

In U.S. Publication No. 2012/0188756, another master/slave LED work light is disclosed. The work light has a power cord that extends entirely through the work light for connecting the work lights together. A master/slave LED work light lighting network and remotely controlled lighting network is disclosed. There is a master light and a number of slave lights that are controlled by the master light. This means that the individual lights cannot be controlled separately. This arrangement has a serious shortcoming if the lighting apparatus is to be used in an area where the lights in the string need to be turned on or off depending on the current situation.

Another type of LED light engines is referred to as strip lights. Strip lights are conventionally flexible strips on which LEDs are mounted, and the flexible strips usually come with an adhesive backing so that they can be attached to walls, fixtures and the like. LED strip lights are sometimes referred to as LED tapes or ribbon lights. Strip lights can be water resistant, and if so they can be used for both indoor and outdoor lighting. Strip lighting is often used for colors other than white. All LED strip lights require a driver and generally operate on a 12 or 24 volt direct current from the driver.

However, strip lighting is often used for such areas as workbench lighting and also for office lighting and artistic lighting. When used with a workbench, strip lighting can be used to eliminate shadows that would often occur with behind the shoulder lighting. LED strip lighting can also be used to eliminate shadows. LED strip lighting also finds use with desks such as with use with a monitor, preferably not being used in a dark room or with strong lights which can cause screen glare. The use of an LED strip light behind the monitor can create a gradual shift between the brightness of the monitor and the light in the rest of the room to reduce eye strain. LED strip lighting can be used in artists' studios to avoid harsh or bright lights which are close to natural light.

U.S. Pat. No. 6,283,612 discloses an LED light strip and incorporates an array of solid state LEDs inside of a transparent or translucent tube. A single power supply can energize up to 350 LEDs in the white configuration. The light strip disclosed in this patent finds particular use in lighting candy displays in stores and markets. The strip light disclosed in this patent has a solidly mounted circuit board held in the tube firmly so that it is vibration resistant. A pair of end caps is located at opposite ends of the tube to plug each end, and a wire penetrates the cap and is potted or sealed so as to make the light waterproof. The light strip includes an electrical cable connected to busses on a single end or on both ends of the light, and a male or female connector can be incorporated. One embodiment of the LED light strip disclosed in the latter patent is said to enable the attachment of a number of light strips together by means of an electric cable and connector for attaching the busses together to prepare for a parallel connection between light strips so that they can be connected together limited only by the ability of the power supply. The individual LED light strips cannot operate separately and must therefore be used on and off together. There is no indication that the light strip set forth in the foregoing patent for anything other than illuminating displays and not in various work areas.

BRIEF SUMMARY OF THE INVENTION

An object of the present invention is to provide an economical lighting fixture for use in a single location but which can be expanded in number to multiple locations.

Another object of the present invention is to provide an economical lighting system which uses low power in comparison to systems having incandescent bulbs or fluorescent bulbs, and which can be used in workplaces or the like in one or a series of locations.

It is yet another object of the present invention is the provision of a lighting system using low power as compared to incandescent or fluorescent lighting systems, incorporating LED arrays in translucent or transparent light transmitting light engines wherein the light engine fixtures can be selectively connected together for various lengths for generating illumination either collectively or individually.

It is still another object of the present invention to provide LED lighting fixtures which can easily be connected together to expand the area of the illumination, and which can easily be disconnected if desired.

It is also an object of the present invention to provide an easily installable strip lighting system whose area of illumination can be changed using an easy to use connection for linking respective LED lighting fixtures together.

Another object of the present invention is to provide linkable lighting fixtures which can be easily and compactly stored, and manually installed for use.

A further object of the present invention is to provide a system of LED strip lighting fixtures which can be connected together by a flexible linking cable having connectors at either end for simple, yet effective connection to strip lighting fixtures that are to be linked together.

A further object of the present invention is to provide a system of LED strip lighting fixtures which can be connected together by a flexible linking cable having connectors at either end for simple, yet effective connection to strip lighting fixtures that are to be linked together.

An additional object of the present invention is to provide LED strip lighting fixtures which can be linked together to expand their areas of illumination.

A related object of the present invention is to provide a linkable LED strip lighting system in which individual strip lighting fixtures can easily be linked together and unlinked from each other.

Another additional object of the present invention is to provide a linkable LED strip lighting system in which the LED strip lighting fixtures, when linked together, can be individually operated.

A still further object of the present invention is to provide an LED shop lighting system which is efficient, effective and easy to use.

A still additional object of the present invention is to provide a linkable LED strip lighting system which is easy to use, easy to operate and efficient in operation.

These and other objects will be apparent to those of ordinary skill in the art from the description to follow and from the appended claims.

The foregoing objects are achieved according to the preferred embodiments of the invention. The term "integrated light engine" is hereinafter referred to as a light engine. Referring to the first embodiment, it incorporates linkable LED shop lighting fixtures. An important feature of the inventive shop lighting system is that two or more inventive linkable LED shop lighting fixtures can be easily linked together. Each linkable LED shop lighting fixture is elongated and incorporates an LED shop light engine which is attached to a cover which can be metal or an appropriate non-metal, the LED shop light engine incorporates a power component, a heat sink and an LED module which in turn includes an array of LEDs which are electrically connected to a printed circuit board. The LED shop light engine further includes a heat sink for absorbing heat generated by the LEDs and a diffuser for spreading the light out to the space to be illuminated. LED light engine electrical connecting portions are part of the LED shop light engine. The LED shop light engine is seated beneath the cover, and a pair of end cap assemblies connects the LED shop light engine to the metal cover to form an LED shop lighting fixture. The end caps have receptacles for receiving a linking device or apparatus including an electricity transmitting plug or a linking plug referred to herein at times as a linking cable, an electrical input plug of a power cable, the other end of the power cable including an outlet plug for insertion into an electrical outlet, or a protective cap. Another linking device is a linking connector. The linking cable and the power cable are sometimes referred to herein as electrical transmitting lines. The preferred embodiment further includes suspension structure such as chains which can be secured to a ceiling so that the metal cover with the components of the LED shop lighting fixture attached thereto can be suspended from the ceiling. A light switch is provided for energizing or de-energizing the respective LED shop light engines individually. The linking devices noted are used to connect the inventive linkable LED shop lighting fixtures together.

Another preferred embodiment of the invention relates to linkable LED strip lighting fixtures incorporating an LED strip light engine. The LED strip light engine fits in a cover forming part of a linkable LED strip lighting fixture. Each linkable LED strip lighting fixture includes an elongated cover that serves as a housing in which is disposed an LED strip light engine, and an LED light engine electrical contacting structure in the form of an end piece or a connecting seat is electrically connected to the LED strip light engine. The latter light engine includes a heat sink and an LED module. The LED module includes an array of LEDs mounted on a printed circuit board that are connected in an electric circuit. An end cap is located at each end of the cover. The end piece and connecting seat have receptacles for receiving a linking plug of a linking device a rigid connector. The lower part of the cover extends over an elongated diffuser for diffusing light emitted by LED strip light engines. The LED strip lighting fixtures can be linked together by electrical linking portions such as a linking cable or a rigid electrical connector.

As used herein, a linkable LED lighting fixture refers to an LED lighting fixture that can be electrically linked to another linkable LED lighting fixture. An LED lighting system refers to two more linkable LED lighting fixtures that are linked together. An LED light engine refers to an illumination device including an LED module, a driver, a heat sink and a diffuser. An LED light engine electrical contacting structure refers to the part of the linkable LED lighting fixture that cooperates with a linking electricity transmitting structure of a linking device such as an inlet plug.

BRIEF DESCRIPTION OF THE DRAWINGS

Objects and advantages together with the operation of the invention, may be better understood by reference to the following detailed description taken in connection with the following illustrations, wherein.

DETAILED DESCRIPTION OF THE PREFERRED EMBODIMENT

Figure 1:
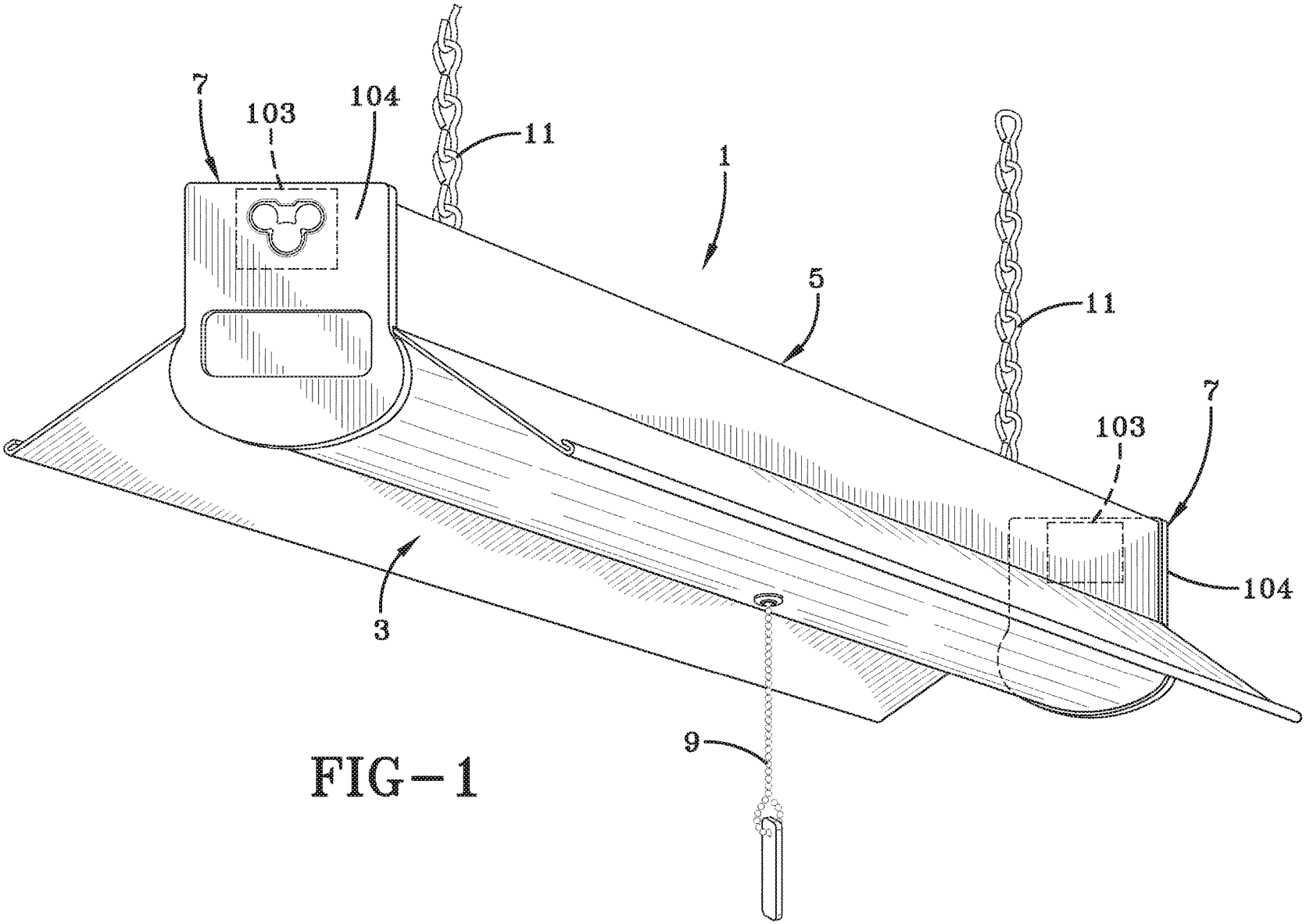
FIG. 1 is a perspective view of a linkable LED shop lighting fixture according to a preferred embodiment of the invention, suspended from metal chains.
Figure 2:
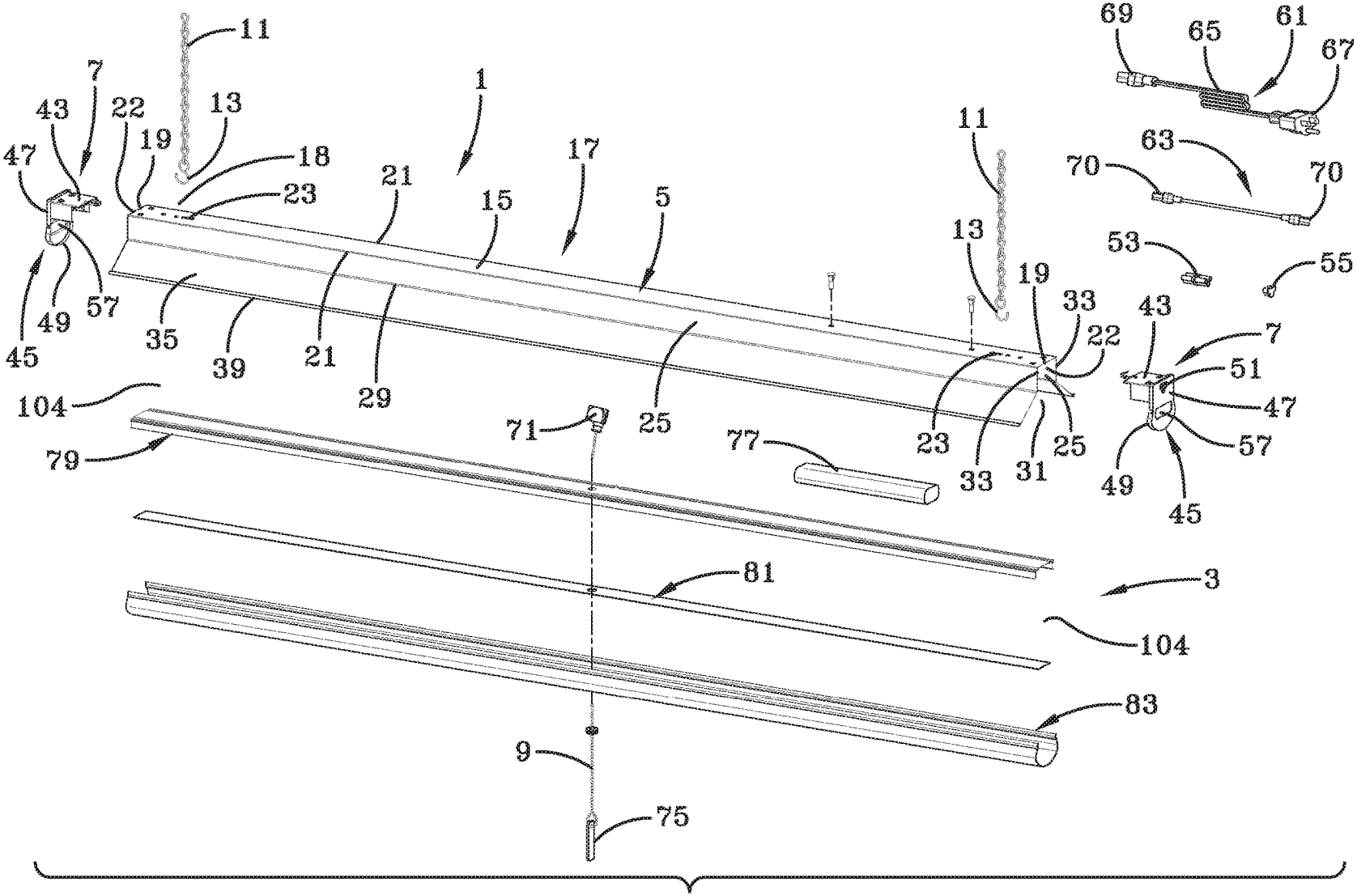
FIG. 2 is an exploded view of some of the components of the LED shop lighting fixture shown in FIG. 1.

One of the preferred embodiments of the present invention is an elongated linkable LED shop lighting fixture 1 as shown in perspective in FIG. 1. Linkable LED shop lighting fixture 1 includes an LED shop light engine 3, a cover 5 which is preferably made from metal such as aluminum, a cap assembly 7 (there is a cap assembly 7 at either end of cover 5), an on-off chain 9 which is preferably made from an appropriate steel or aluminum. A pair of suspension chains 11 can be provided, which may be made from an appropriate metal such as steel or aluminum from which linkable LED shop lighting fixture 1 would be suspended. On-off chain 9 is a chain for controlling an on-off switch. An exploded view of linkable LED shop lighting fixture 1 is shown in FIG. 2. Cover 5 can be hooked on suspension chains 11 which would be held fast by a ceiling or other upper support structure. Suspension chains 11 have at their respective bottoms a hook 13 for extending through two pairs of chain-holding holes 23 in a rectangular top wall 15 of cover 5.

Cover 5 includes a five sided shade 17 having rectangular top wall 15 which has opposing straight opposing parallel end edges 19, and parallel opposing straight longitudinal edges 21. Shade 17 also has opposite shade end portions 18. Cover 5 further comprises a pair of identical opposing rectangular side walls 25. Side walls 25 have a first pair of opposing parallel longitudinal edges which are connected to and from common longitudinal edges 21 of top wall 15. Side walls 25 further have a second pair of opposing parallel longitudinal edges 29 spaced from said first pair of opposing longitudinal edges 21. Rectangular top wall 15 and opposing rectangular side walls 25 form a three sided cavity 31 in the configuration of a parallelepiped having an open bottom. Cavity 31 is defined at its end by upper end edge which is coincident with straight opposing parallel end edges 19 of top wall 15 and opposing parallel side edges 33 which are also the end edges of side walls 25.

Cover 5 has opposing identical rectangular side flange walls 35. Each flange wall 35 has a pair of parallel longitudinal edges that are the same as the second pair of opposing parallel longitudinal edges 29 of respective side walls 25 and also identified by numeral 29, and a second pair of opposing parallel longitudinal free edges 39. Side flange walls 35 are inclined by equal amounts from parallel rectangular side walls 25 and are symmetrical therewith.

A pair of end cap assemblies 7 cooperates with cover 5 to close the ends of three sided cavity 31. Each end cap assembly 7 comprises an upper flat plate 43 having a width equal to the distance between longitudinal edges 21 of rectangular top wall 15 so that upper flat plate 43 can rest against the underside of top wall 15. Upper flat plate 43 is preferably attached to top wall 15 by means of a single screw with a lock washer, and a pair of resilient tabs (which are plastic when upper flat plate 43 is plastic) for extending through holes near end of top wall 15. End cap assembly 7 further includes an end cover 45 which is flat and extends downwardly from upper flat plate 43 and has an upper rectangular cover portion 47 which closes the respective open ends of three-sided cavity 31, and a lower partially-circular portion 49 having a curved portion for covering the end of LED shop light engine 3 installed within cover 5 as discussed below. Electrical connection to LED shop light engine 3 is preferably made by two pairs of electrical conducting wires extending from a driver discussed below and extending respectively to end cap assembly 7. The electrical conducting wires are attached to a pair of electrically insulated partial embedded orifices forming a part of a set of orifices in respective end cap assemblies 7. More specifically, each end cap assembly 7 includes a set 51 of linking orifices, which is an access for a linking connector. Set 51 preferably has the shape of three overlapping, equiangularly located circles or a trefoil forming the end of three overlapping or partial cylinders for providing access for receiving a linking device such as an electrical input plug 69, a linking plug 70, a linking connector or end-to-end connector 53 or a protective cap 55. Input plug 69 and linking plug 70 are normally identical. Each of the pair of partial embedded orifices has an internal, axial conducting tube which is electrically connected to provide electrical power to LED shop light engine 3. A third axial conducting tube in third embedded orifice is connected to an electrical conducting grounding plate attached to each of end cap assemblies 7. The foregoing conducting members are preferably made of copper. Other forms of electrical connection fall within the scope of the invention. The partial embedded orifices with their conducting tubes are designated broadly as LED light engine electrical contacting structure.

LED shop lighting fixture 1 can include suspension chains 11. A linking device has electrical transmitting plugs, the linking device can take the form of a power cable 61 and a linking cord or linking cable 63. Both are both shown in FIG. 2, and a further device is discussed hereinafter. Power cable 61 includes as its electrical transmitting plugs disposed on an insulated electrical line 65, an electric outlet plug with standard electrical prongs 67 and an electrical light engine fixture plug 69 at the opposite ends of electrical line 65. Electrical light engine fixture inlet plug 69 has three equiangularly-spaced partial tubular inserts. The partial tubular inserts of each of each inlet plug 69, each linking plug 70 and each linking connector 53 described herein have conductive lines made of copper having diameters to receive conductive tubes in the linking orifice in a snug relation to permit proper transmission of electric current. As explained above, the three partial tubular inserts of electrical light engine fixture plug 69 have axial linings made from copper (or other electrical conducting) material and are arranged to make contact with the cylindrical tubes in each end cap assembly 7. Each of the linking devices, i.e. linking connector 53, electrical input plug 69, and linking plug 70 must have appropriate electrical conductor construction to operatively connect with the LED light engine electrically contacting structure. The foregoing electrically conductor construction can be described as linking electricity transmitting structure. In other words, each of linking connector 53, electric input plug 69 and linking plug 70 has three peripherally connected plastic tubes with copper or other electrical conducting sleeves, which when inserted into linking orifice 51 of LED shop light engine 3 (other than a grounding orifice), effects an electrical conducting transmission line with LED shop light engine 3. The linking electricity transmitting structure cooperates with the LED light engine electrically contacting structure to transmit electricity between the respective plug and linking connector to another LED light engine or from a power outlet to the respective LED light engine. Power cable 61 is used to supply electric power to LED shop lighting fixture 1, and is accomplished by inserting the prongs of electric outlet plug 67 in an ordinary wall socket and by inserting electrical input plug 69 into linking orifices 51 of end cap assembly 7. Electrical conducting wires from the tubular prongs are connected to a driver 77 discussed below. Linking cable 63 is used to link or connect a pair of linkable LED shop lighting fixtures 1 together so that each of the linked-together linkable LED shop lighting fixtures 1 can be operated individually, so long as electrical outlet plug 67 of power cable 61 is inserted in an electrical outlet and electrical input plug 69 is inserted in linking orifice 51 in an end of the linked together LED shop lighting fixtures 1. Linking cable 63 has linking plugs 70 at its opposite ends, and linking plugs 70 of a linking cable 63 can easily be inserted in linking orifice 51 of adjacent shop lighting fixtures 1 so that the linked in LED shop lighting fixtures 1 can be operated together. Since LED shop light engine 3 and a diffuser 83 are elongated, the foregoing fixture is also referred to as an elongated, linkable, LED shop lighting fixture.

In order to activate LED shop light engine 3 held within cover 5, a switch 71 is provided. Switch 71 is included in the electrical circuit that includes the foregoing shop light engine 3 as discussed hereinafter. On-off chain 9 is attached to switch 71, and it includes tags 75 for identifying linkable LED shop lighting fixture 1.

Figure 6:
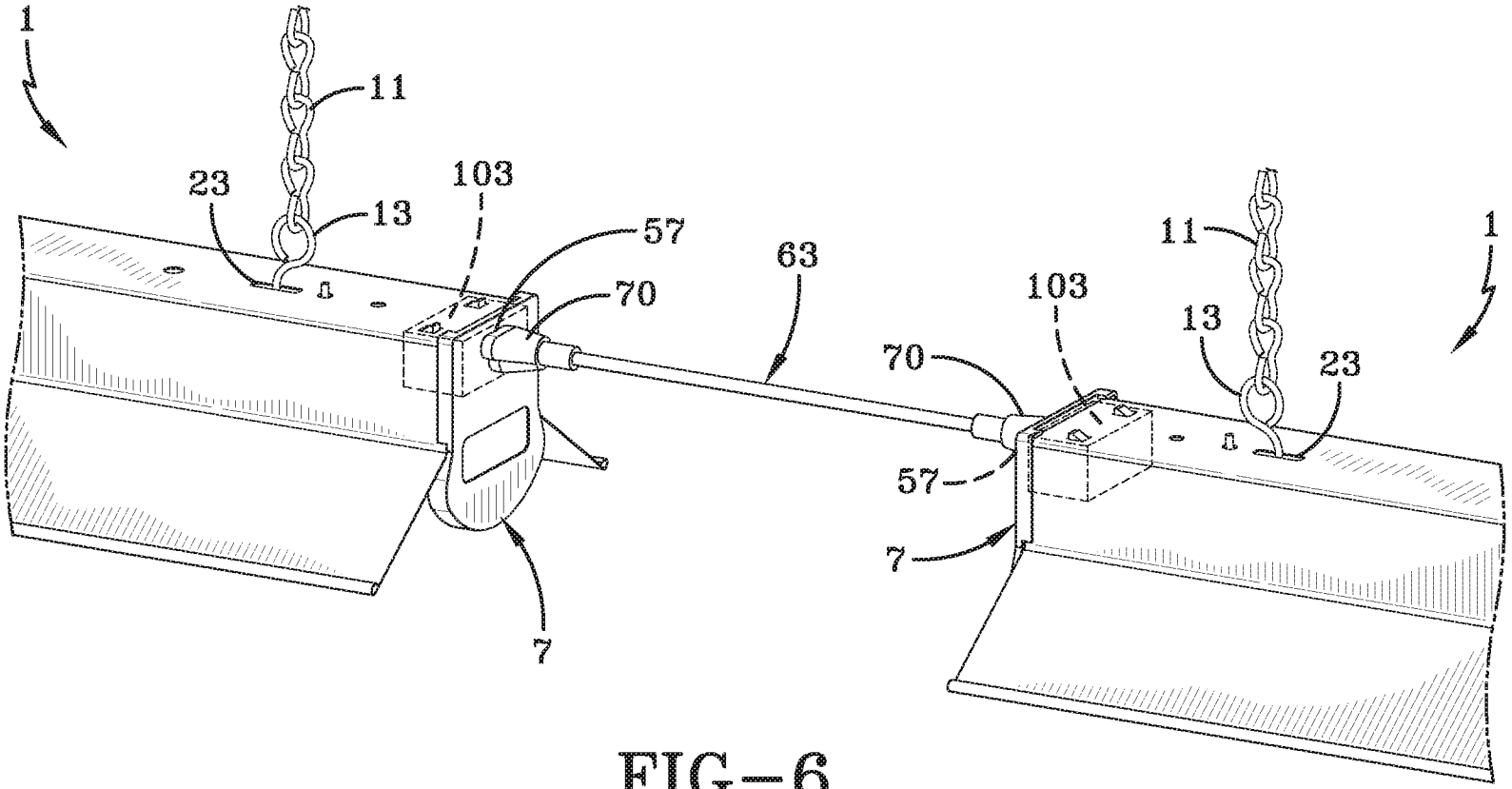
FIG. 6 is a partial perspective view of a linkable LED shop light system incorporating a pair of linkable LED shop lighting fixtures of the type incorporated in the linkable LED shop lighting fixtures shown in FIG. 2, connected together by a linking cable.

LED shop light engine 3 includes driver 77, a heat sink 79, an LED module 81, diffuser 83, and electrical conductors for transmitting electrical current to light engine 3. Driver 77 is used to provide electrical power in the correct form to LED shop light engine 3. Electrical conducting wires are connected to LED module 81. Heat sink 79 is provided for absorbing and transmitting heat generated by LED module 81 when shop light engine 83 is illuminated. LED module 81 is provided adjacent heat sink 79. LED module 81 comprises LED chips that are mounted on a printed circuit board that use surface-mounted technology. Finally, diffuser 83 is provided in part for containing driver 77, heat sink 79 and LED module 81. Diffuser 83 spreads the illumination from LED module 81 in a desired pattern, which essentially directs most of the illumination downwardly to the space to be illuminated. LED shop lighting fixture 1 further includes end connectors 103 shown in FIGS. 1 and 6 schematically (but which can be of any appropriate type including those in the known art) at a LED shop light engine end portion 104 of end cap assembly 7 through which electrical connection can be made with LED shop light engine 3.

Figure 3:
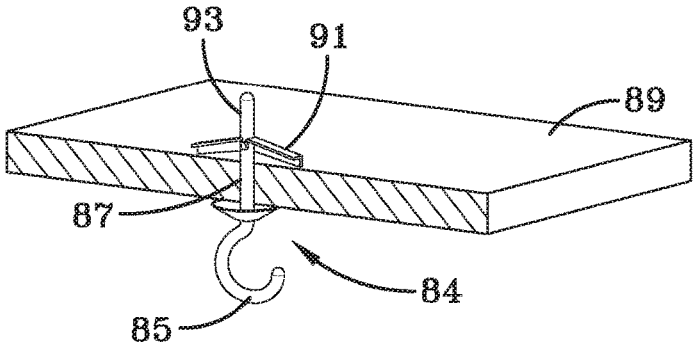
FIGS. 3-5 show components of a linkable LED shop lighting fixture according to a preferred embodiment of the invention being installed from on a drywall and from a ceiling.
Figure 4:
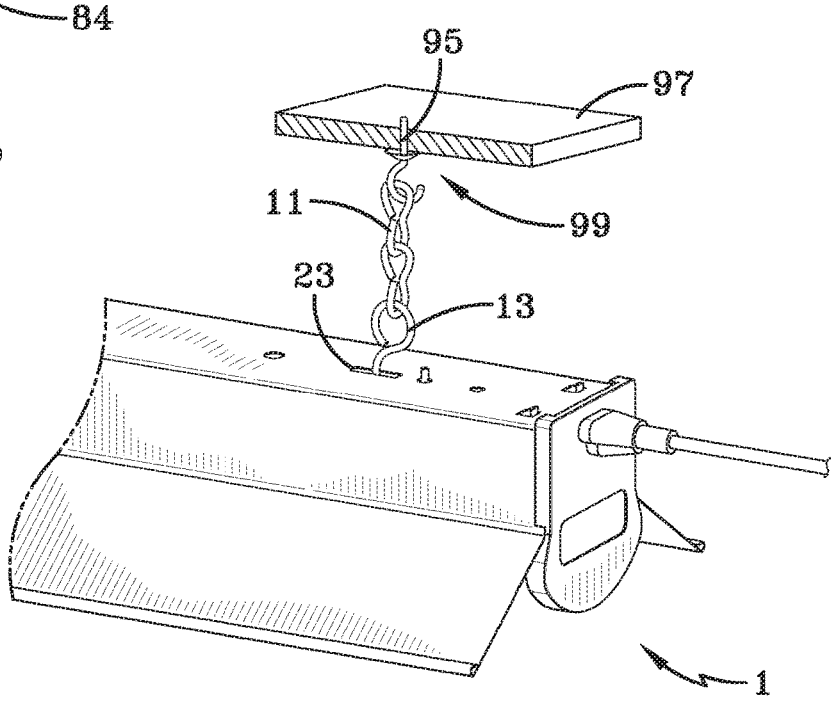
Figure 5:
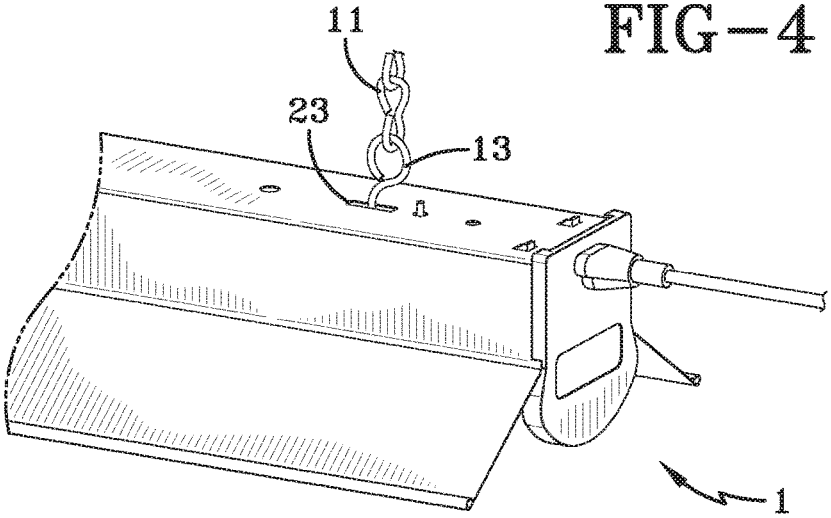

Linkable LED shop lighting fixture 1 is very easy to install. In order to install shop lighting fixture 1 to a drywall ceiling 89 as shown in FIG. 3, the installer uses a toggle bolt 84 with a toggle bolt hook 85. A small hole 87, which should be around ¼", is drilled in drywall ceiling 89. The installer inserts a bolt 93 through hole 87 with a pair of flaps 91 in a folded position until flaps 91 are on the upper part of drywall ceiling 89, at which time they open up as shown in FIG. 3. Toggle bolt 93 is then tightened. If a wood ceiling is used, the installer would drill a small hole 95 into a wood ceiling 97 as illustrated in FIG. 4 and install a bolt hook 99 therein. In either case, hook 13 at the lower, free end of suspension chains 11, is inserted through each pair of chain holding holes 23 as shown in FIGS. 4 and 5. In this manner, shop lighting fixture 1 is easily installed in either of ceilings 89 or 97.

There are two ways depicted in which adjacent linkable LED shop lighting fixtures 1 can be linked to another LED shop lighting fixture together to form an LED shop lighting system 100. With reference to FIG. 6, linking cable 63 is used to link together LED shop lighting fixtures 1. It can be seen that the two linking plugs 70 are inserted in linking orifices 51 (shown in FIG. 2) extending through the respective end cap assemblies 7 at the adjacent ends of LED shop lighting fixtures 1. Linking cable 63 is flexible, and linkable LED shop lighting fixtures 1 do not have to be in alignment as they are shown, but could be at an angle relative to each other could be at different distances from the ceiling and need not be parallel to each other. Furthermore, linking cable 63 can be held taut as shown in FIG. 6, but can also have some slack in it as well.

Figure 20:
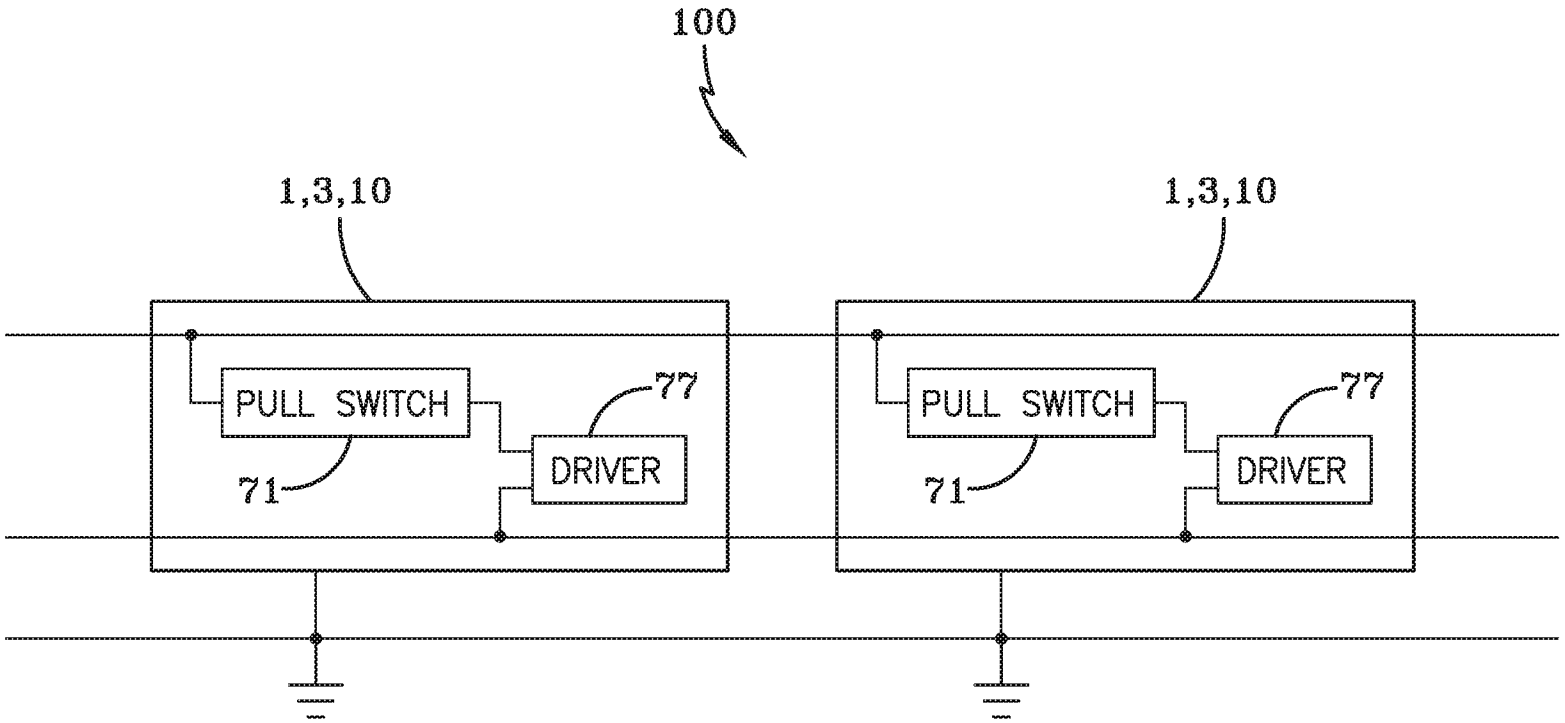
FIG. 20 is an electric circuit diagram showing the switching arrangement for a linkable LED shop lighting system according to a preferred embodiment of the invention.

Reference is made to FIG. 20 showing the electrical connection of a pair of LED shop light engines 3 in LED shop lighting fixtures 1 to form an LED shop lighting system 100. Two LED shop light engines 3 in LED shop lighting fixtures 1 are linked together. Switch 71 is connected in series with driver 77 in each of the pair of LED linked shop lighting fixtures 1 including LED shop light engines 3. Each circuit is connected to ground. Each LED shop light engine 3 has a pull switch 71 for operating driver 77 or for deactivating driver 77. Each pull switch 71 can thus be operated to activate the respective LED light engines 3 to turn them on or off. Modifications can be made for switching apparatus to activate or deactivate all of the LED light engines simultaneously.

Figure 7:
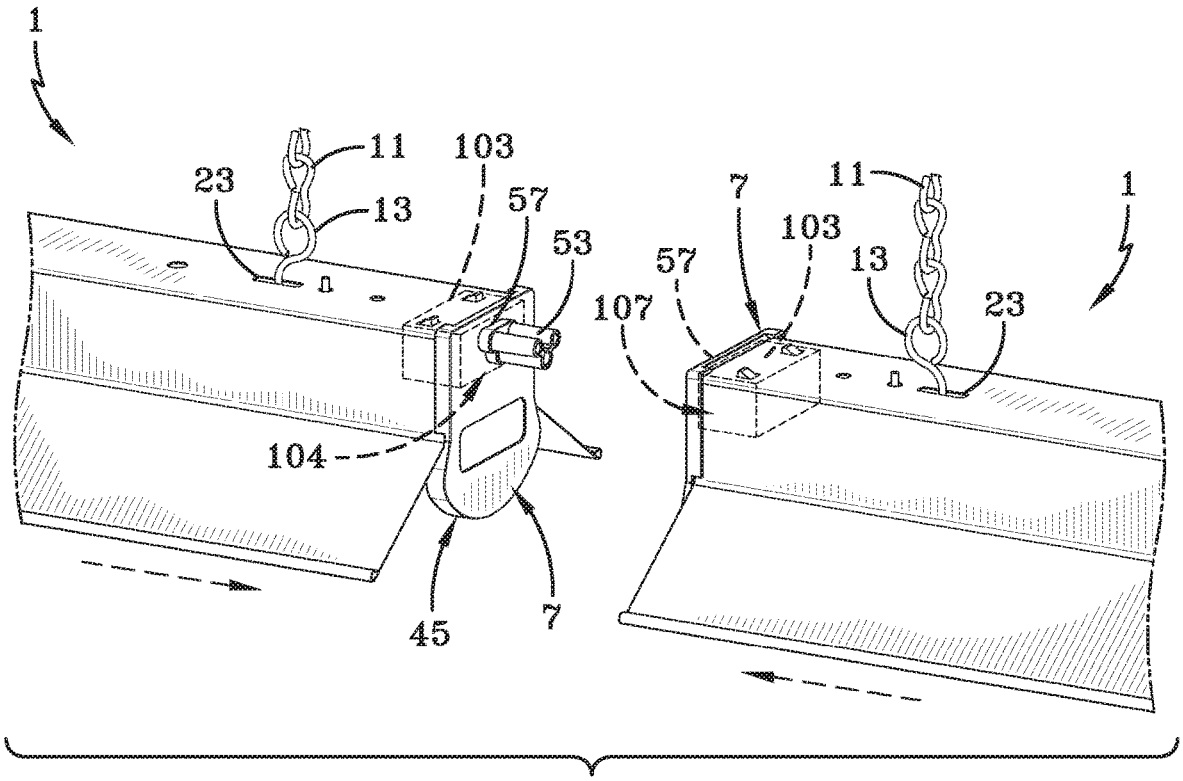
FIGS. 7 and 7A are partial perspective views of a linkable LED shop lighting system composed of a pair of LED shop lighting fixtures about to be and then connected together by a rigid connector.
Figure 7A:
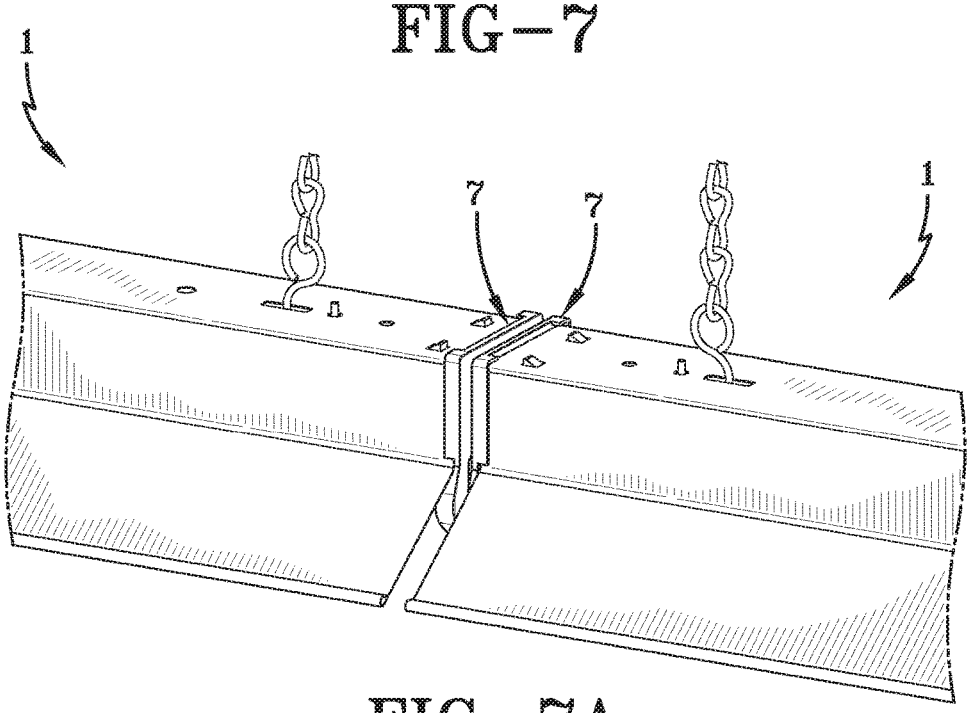

Referring to FIGS. 7 and 7*a*, linking connector 53, which is preferably rigid, is shown installed into linking orifices 51 of one linkable LED shop lighting fixture 1 and positioned for insertion into linking orifice 51 in the adjacent linkable LED shop lighting fixture 1. Once linking connector 53 is installed in both linking orifices 51 and linkable LED shop lighting fixtures 1 are urged together as shown in FIG. 7*a*, shop lighting fixtures 1 are firmly connected together as shown in FIG. 7*a*, and their respective end piece covers 45 either engage each other or are very close to such engaging. Linking connectors 53 could be long, yet still make the electrical connection with each other. Linking connector 53 is preferably short, about an inch and a quarter (¼ inches) in length, but it could be of any length. Linking connector 53 is preferably symmetrical at both ends, and two sets of three peripherally connected cylindrical tubes extend linearly, each set being directed in opposite directions. Each tube has an open free end. There are copper or other electrical conducting tubular sleeves for engaging conductors in each of a pair of orifices of set 51 in which the respective cylindrical tubes of linking connectors 53 is inserted in linkable LED shop lighting fixtures. The sleeves thus contact the axial tubular extensions of the tubular sleeves in end cap assembly 7. When end cap assembly 7 has set 51 of linking orifices, each linking connector 53 is likewise equiangularly-spaced to be inserted into end cap assemblies 7. The tubes have copper or other electrical conducting tubular sleeves. At either ends, the tubes having cylindrical holes forming the prong receptacles. Each set of connected cylindrical tubes of linking connectors 53 have a trefoil orientation. Thickened band 57 of linking connector 53 is provided at the midsection linking connector 53 which acts as a shoulder for engaging the surface around the two sets of respective three cylindrical tubes having linking orifices 51 to limit the insertion of linking connector 53 into each end cap assembly 7.

Any number of linkable LED shop light fixtures 1 can be linked together using either linking cables 63 or linking connectors 53. One power cable 61 is used in order to energize a single LED shop lighting fixture 1 or a series of LED shop lighting fixtures 1 that are linked together. Each of system of linked together LED shop lighting fixtures 1 can be operated independently by means of the actuation of switch 71 by means of a chain by simply pulling the chain to turn the respective linkable LED shop lighting fixtures 1 on and off.

Figure 8:
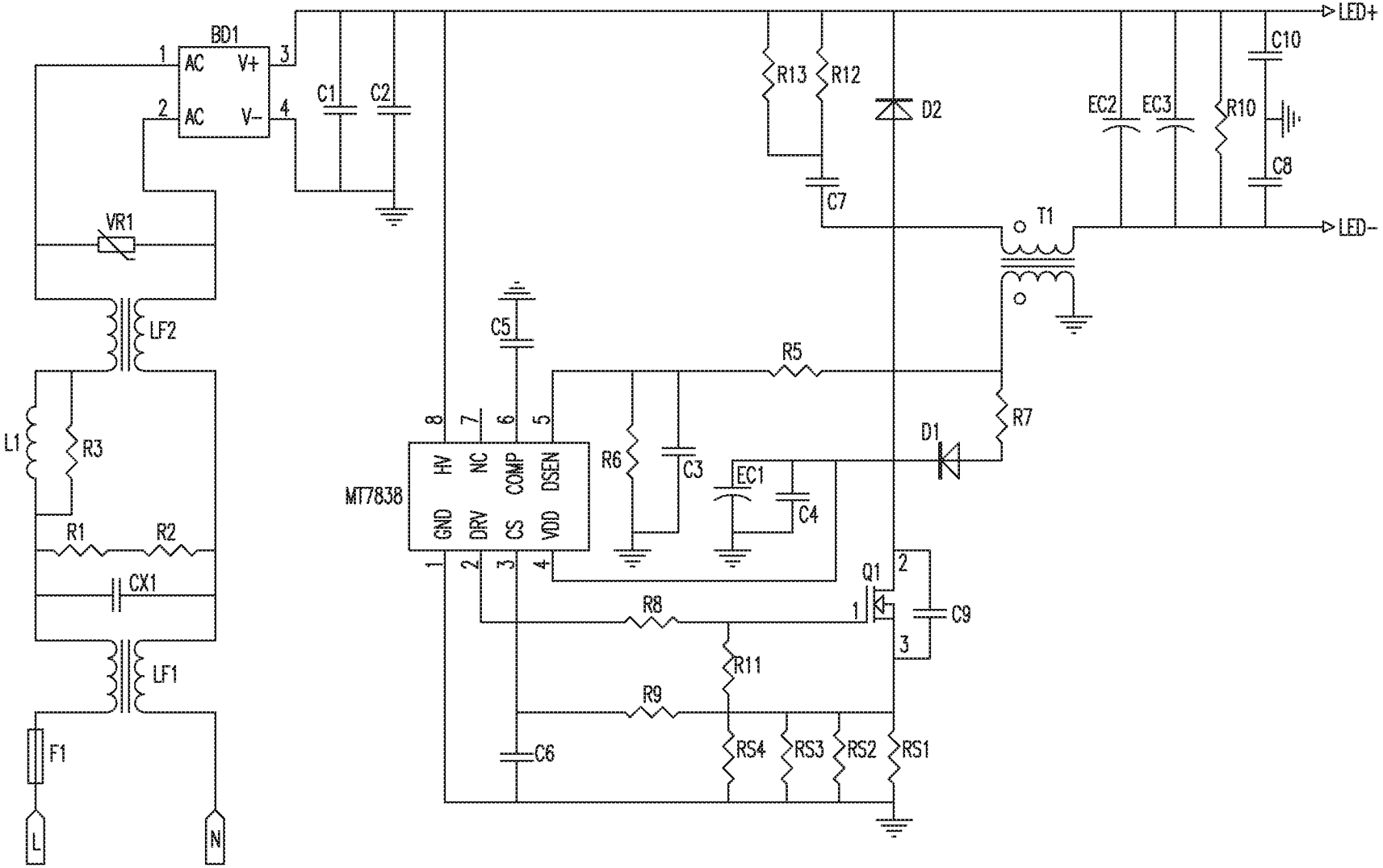
FIG. 8 is a circuit diagram of the electrical components for use in the linkable LED shop lighting fixture shown in the preceding figures.

A circuit diagram 101 for linkable LED shop light fixture 1 is shown in FIG. 8. There is a pair of inputs L and N with a fuse F1 in series with input L which are connected to a transformer LF1 to which is connected a circuit component including a capacitor CX1 which is parallel with resisters R1 and R2. Also in this circuit component is an inductor L1 connected in parallel with a resister R3. Another transformer LF2 is connected to a circuit component having a variable resister VR1 which is in turn connected to an AC/DC converter BD1. The output of the latter, V+ and V− connected across a pair of capacitors C1 and C2. These are in turn connected to a circuit having a control component. Components C1-C10 are capacitors. D1 and D2 are diodes.

The component labelled MT7838 is a single-stage buck average constant current controller. T1 is a transformer which is connected to the ground. BD1 is a current compressor and VR1 is a voltage reducer. The bridge having capacitors C1 and C2 are connected to ground, as are capacitor C5 and the circuit including RS1-RS4, C6 and R9. EC1-EC4 are polarized capacitors.

Figure 9:
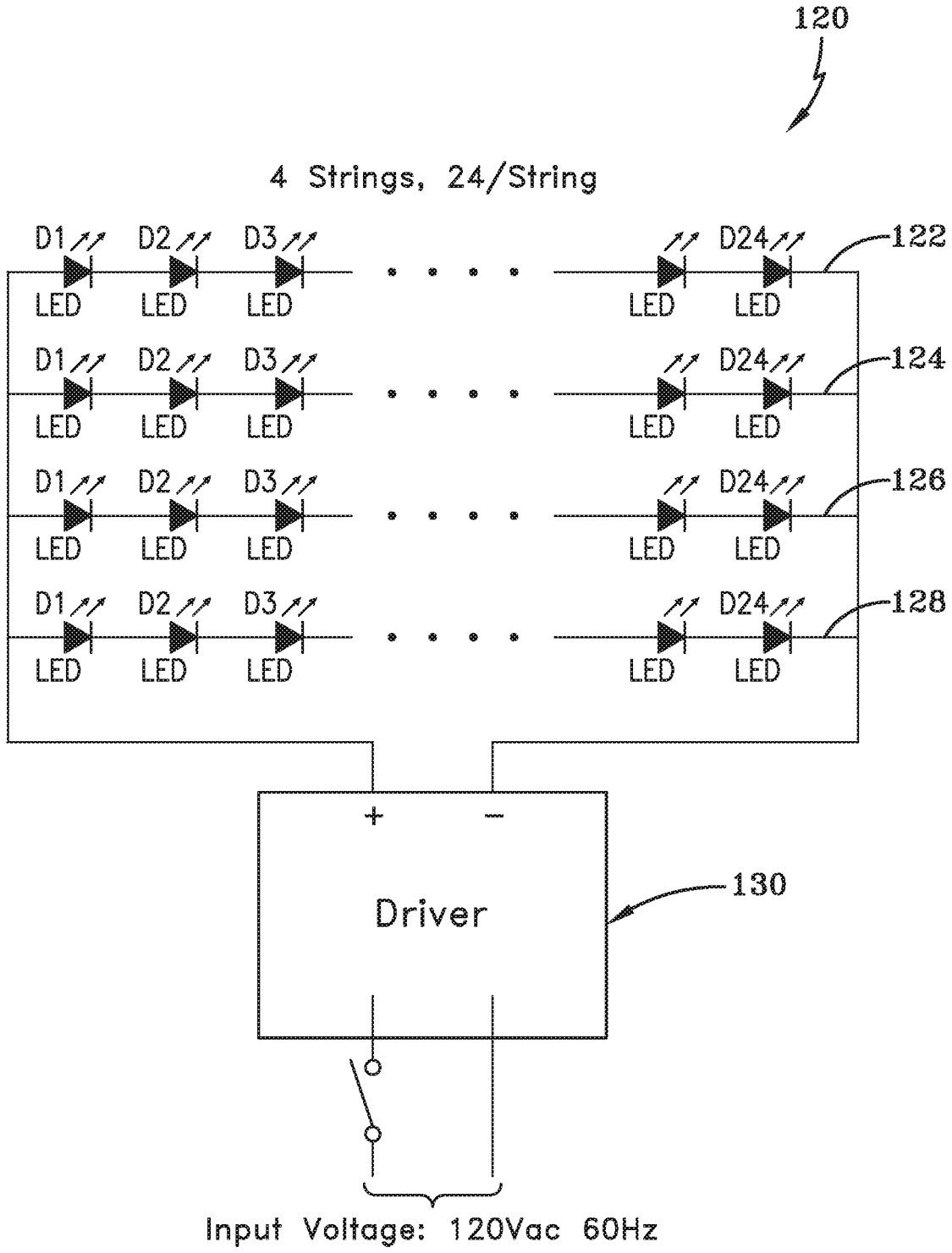
FIG. 9 is a circuit diagram for the electrical components of a LED shop light engine shown in some of the preceding figures with a driver.

Referring to FIG. 9, an LED strip circuit 120 is shown. Strip circuit 120 has four strings 122, 124, 126 and 128, each having twenty four LEDs. These are powered by a driver 130.

Figure 10:
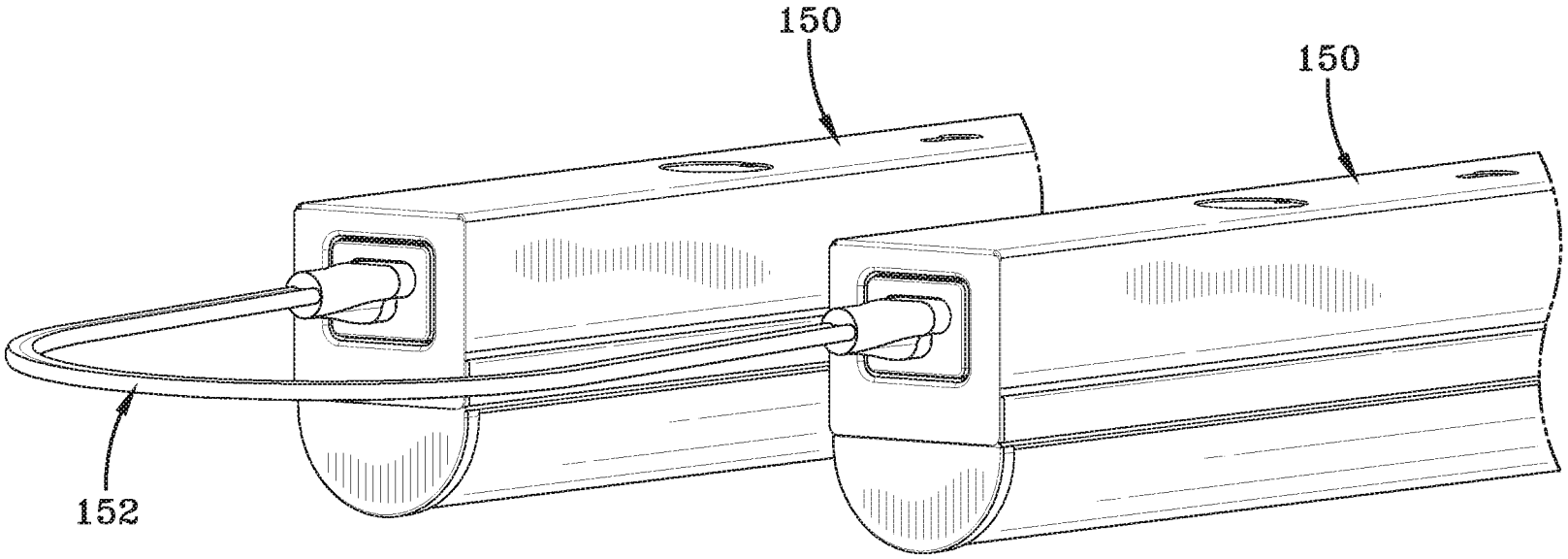
FIG. 10 is a perspective view of a portion of a linkable LED string lighting system according to an embodiment of the invention incorporating a pair of linkable LED strip lighting fixtures that are linked together.

Referring to FIG. 10, a pair of respective linkable LED strip light fixtures 150 is shown which are connected by a linking cable 152. A series of LED strip light fixtures 150 can be connected together for a virtual unlimited number of linkable LED strip light fixtures 150 by means of sequential linking cables 152. A power cable would be required to connect an end of LED strip light fixtures 150 to a power source.

Figure 11:
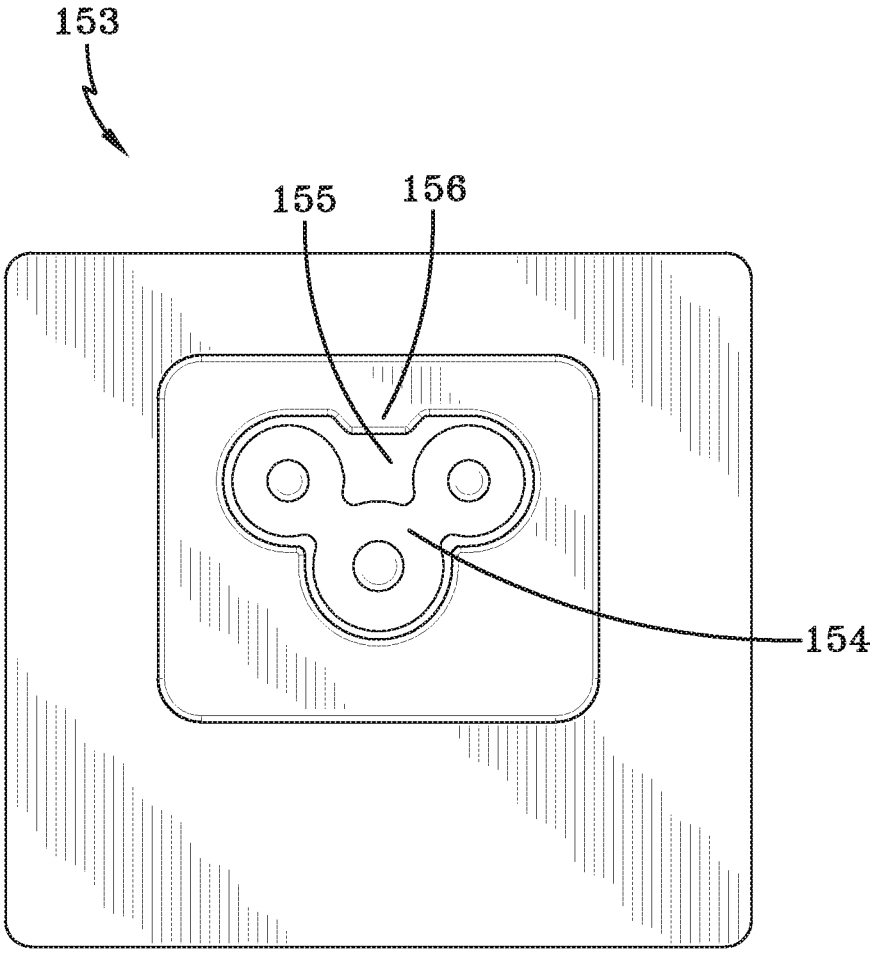
FIG. 11 is an end view of one of the linkable LED strip lighting fixture of the type shown in FIG. 10 with an installed protective cap.

Referring to FIG. 11, an end view of a linkable LED strip lighting fixture 153 is shown. An end connector or linking opening 155 (discussed below) in which a linking plug (discussed below) is to be inserted should be protected when not in use. Therefore, a protective cap 154 having a trefoil configuration, which is the same configuration as that leading to the end connector opening, is used to protect the end connector opening 155. Protective cap 154 has a depression 156 into which an implement can be inserted for removing protective cap 154 from the end connector opening.

Figure 12:
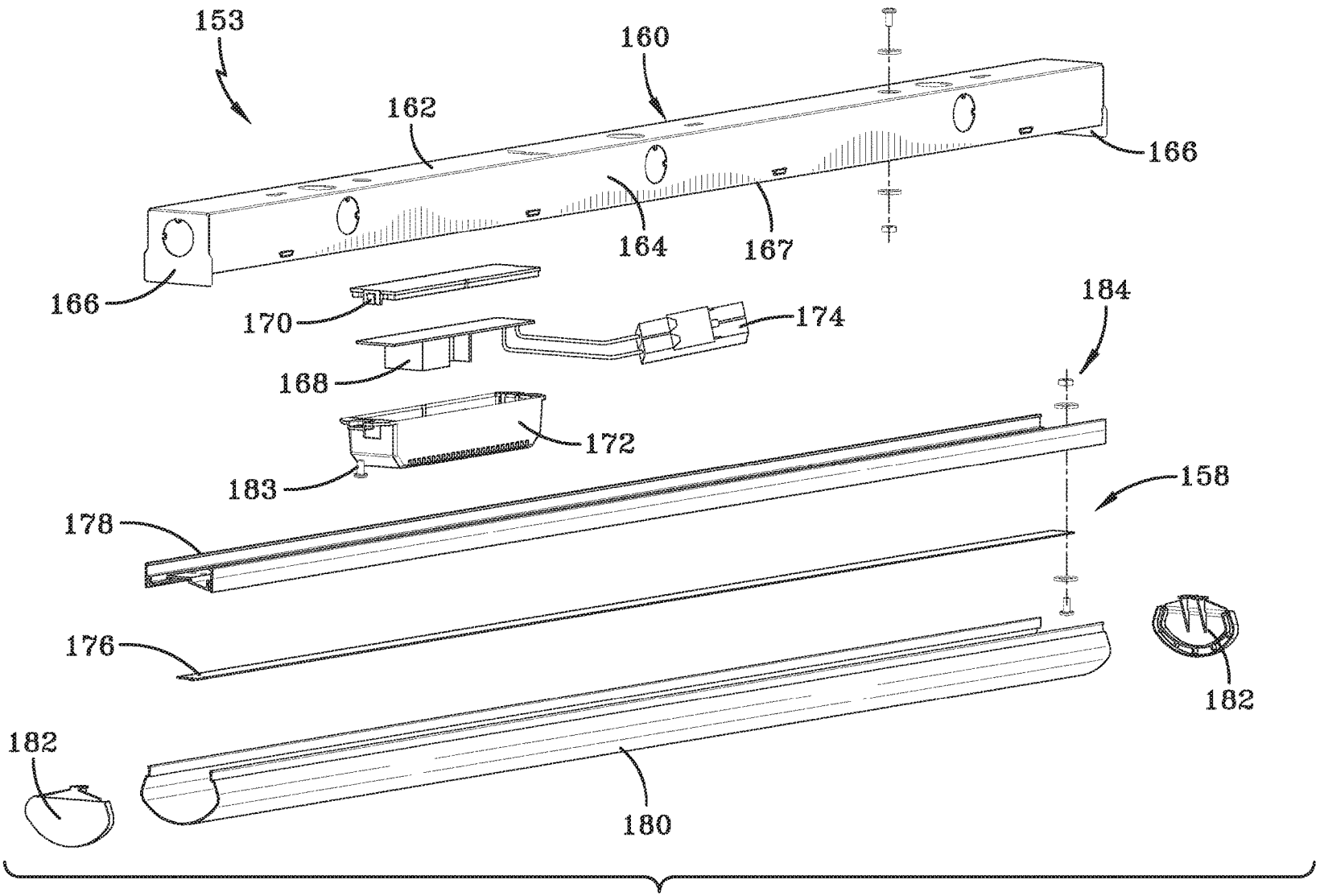
FIG. 12 is an exploded view of one of the linkable LED strip lighting fixtures as incorporated in the system shown in FIG. 10.

An exploded view of one form of linkable LED strip lighting fixture 153 is shown in FIG. 12. Linkable LED strip lighting fixture 153 includes a housing 160 which comprises a top piece 162 and a pair of parallel, opposing, and elongated side walls 164 with a pair of opposing end pieces 166 which are mounted across the coplanar parallel ends of top piece 162. Side walls 164 have elongated, side wall bottom edges 167.

LED strip lighting fixture 153 includes an LED strip light engine 158 which includes a driver 168 above which is a driver box bottom 170. Driver 168 fits inside a driver box top 172 and driver box bottom 170 to be enclosed therein. A power plug 174 is provided for attachment to driver 168 for transmitting electric power thereto.

An LED module 176 is an elongated member having a plurality of strips of LEDs included therein. A heat sink 178 which is of about the same length as LED module 176, and it is provided for absorbing the heat generated by LED module 176. Also attached to housing 160 is a diffuser 180 which receives LED module 176 and heat sink 178, and which is clipped to the bottom of housing 160. Diffuser 180 diffuses illumination from LED module 176 in a generally downward direction.

A pair of end covers 182 clip onto the ends of diffuser 180 to protect the interior of diffuser 180 and the parts that it encloses, from contaminants in the ambient air.

A screw assembly 183 is used for attaching driver box top with driver 168 and driver box bottom 170 to housing 160. Screw, washer and nut assembly attach the illumination components including diffuser 180, LED module 176 and heat sink 178 to housing 160.

Figure 13:
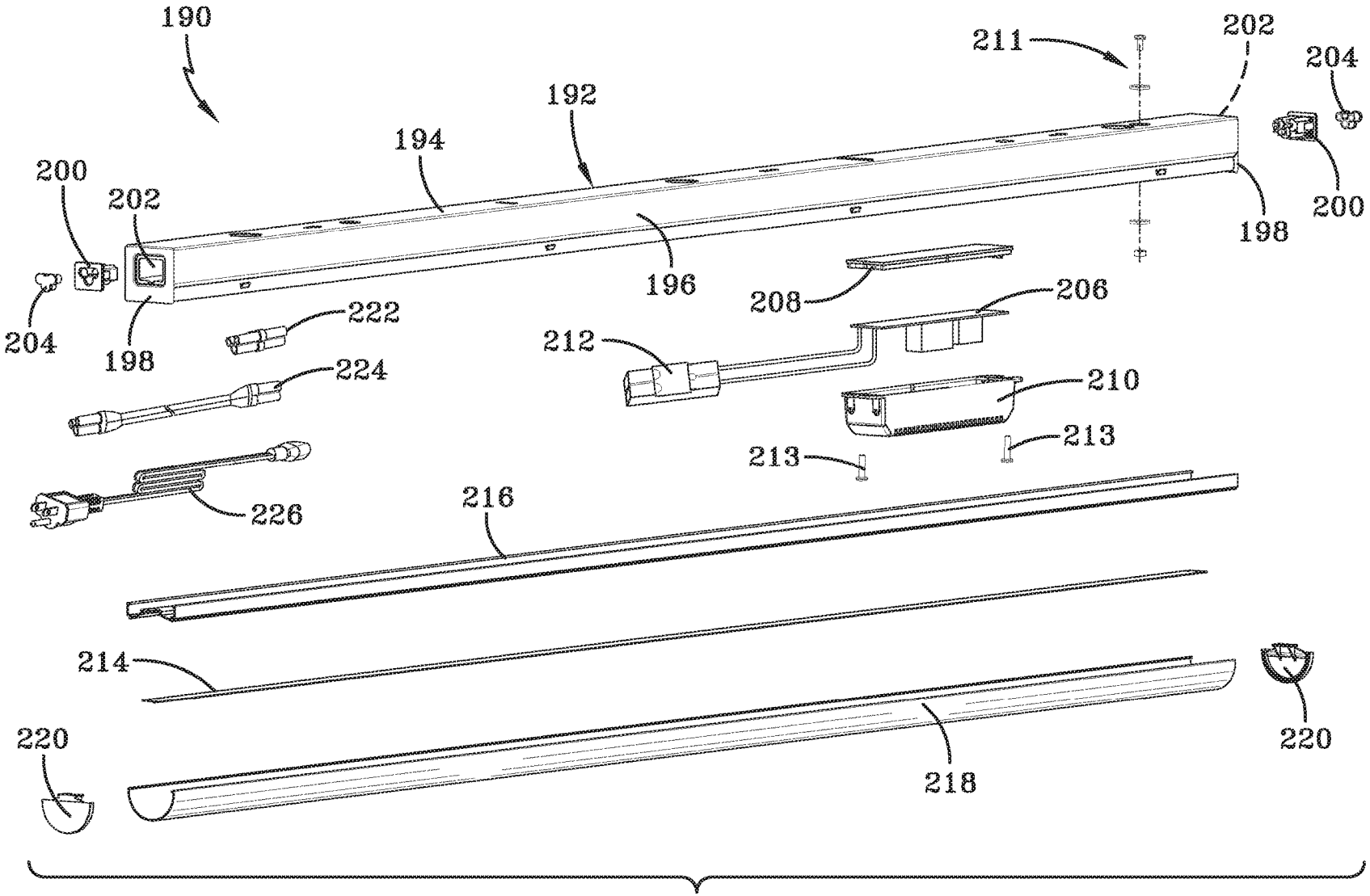
FIG. 13 is an exploded view of another version of a linkable LED strip lighting fixture according to a preferred embodiment of the invention.

Another size of an LED strip light fixture is shown in FIG. 13. Referring to FIG. 13, a linkable LED strip lighting fixture 190 is shown. LED strip lighting fixture 190 includes a cover or housing 192 having a top wall 194, and extending downwardly from its opposing parallel edges is a pair of side walls 196, to form three walls of a rectangular parallelepiped having an open bottom opposite top wall 194. Housing 192 has a pair of end pieces 198 which are disposed at the opposite ends of housing 192. Connecting seats 200 are disposed in apertures 202 in respective end pieces 198. Connecting seats 200 have a trefoil-shaped opening for receiving a linking plug, an electrical input plug or a protective cap 204 for the protection of the interior of connecting seat 200, when a plug is not installed therein. A linking cable or linking cord 224 similar to linking cable 63 or a linking connector 222 similar to linking connector 53 discussed with respect to linkable LED shop light fixture 1 are provided. Reference is made to the discussion regarding linking connector 53 for a description of linking connector 222. A power cable or power cord 226 is similar to power cable 61 is required when fixture 190 is to be turned on for illumination. Reference is made to the discussion of power cable 61 for the description of the components of the electric input plug and the outlet plug included in power cable 226.

The following parts are those from known strip light fixtures. These include a driver 206, a driver box bottom 208, a driver box top 210 and a screw assembly 211 for attaching driver box top 210 to driver box bottom 208 for enclosing driver 206. A power plug 212 is also provided for power for driver 206. Screws 213 attach driver box bottom 208 to driver box top 210 to enclose driver 206. Strip lighting fixture 190 further includes an LED module 214, a heat sink 216, a diffuser 218 and a pair of opposing end covers 220.

Figure 14:
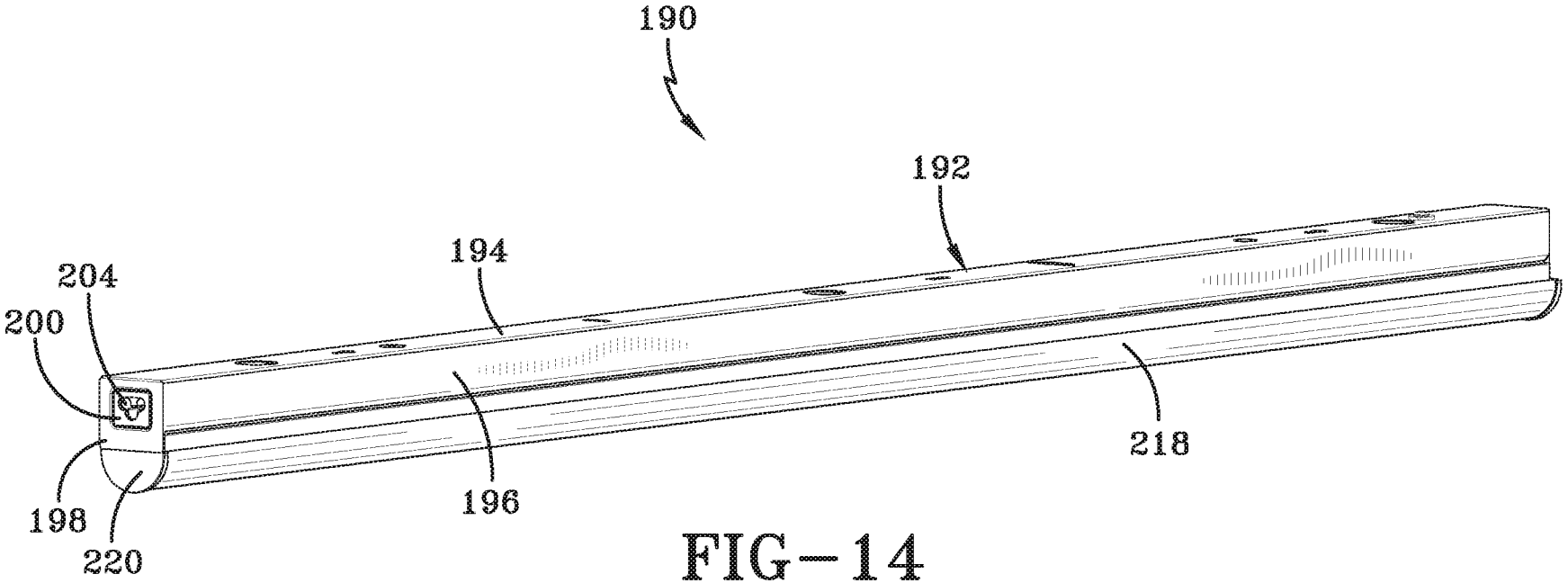
FIGS. 14-18 are respective perspective, top, front, end and bottom views of the subassembly of a linkable LED strip lighting fixture according to an embodiment of the invention shown in FIG. 13.

Drawings of the entire strip light assembly 190 are shown in FIGS. 14-18. FIG. 14 shows LED strip lighting fixture 190 in perspective form. Shown in FIG. 14 are housing 192 with top wall 194 and side wall 196, end piece 198 having inserted therein connecting seat 200 with protective cap 204. Located between end covers 220 is diffuser 218.

Figure 15:
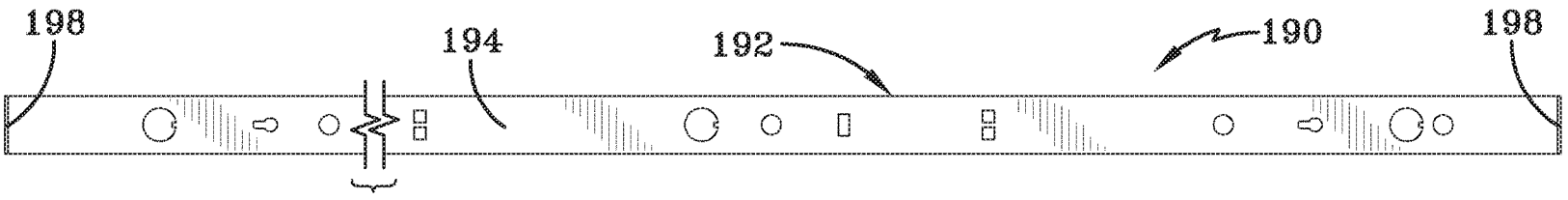
Figure 16:
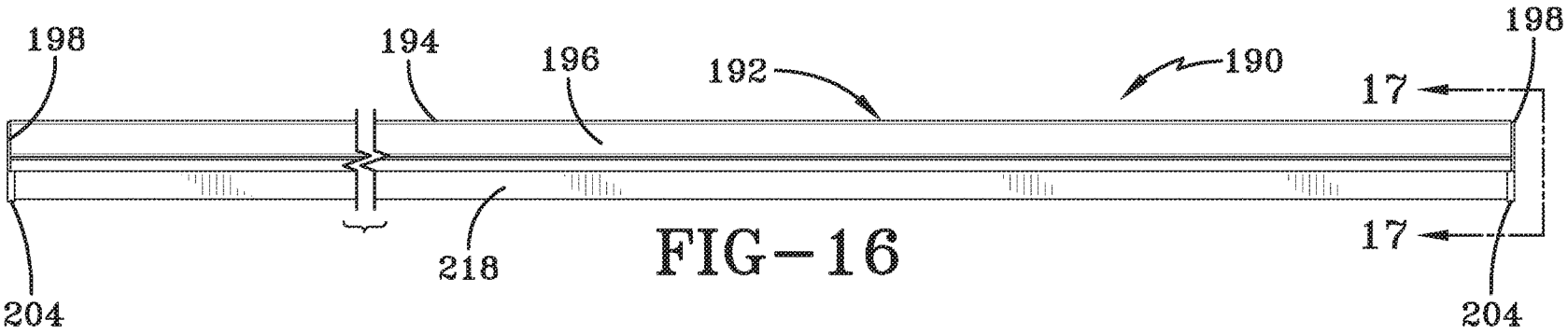
Figure 17:
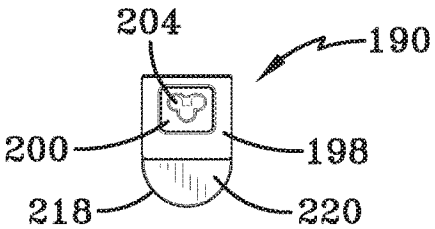
Figure 18:
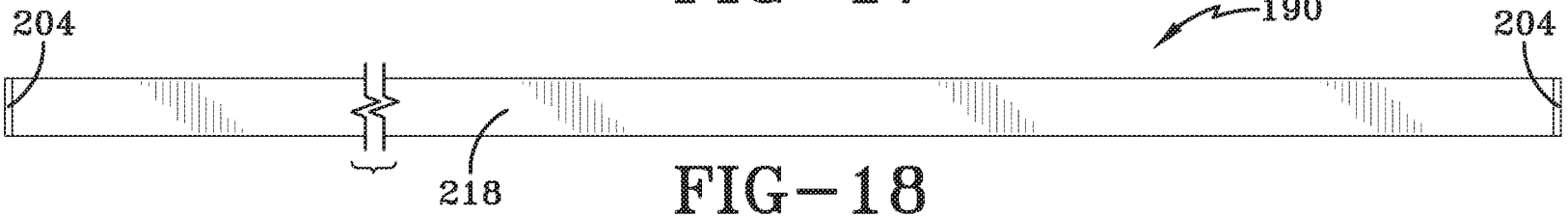

FIG. 15 shows a top view of linkable LED strip lighting fixture 190 in which can be seen top wall 194 of housing 192. A front view of LED strip lighting fixture 190 is depicted in FIG. 16. Housing 192 is shown on which side wall 196 is visible. The lower portion of LED strip lighting fixture 190 is diffuser 218. The end view of LED lighting fixture 190 is shown in FIG. 17. End cover 220 is shown below end piece 198 in which are located connecting seat 200 in which his located protective cap 204. Referring to FIG. 18, the bottom view of LED strip lighting fixture 190 shows diffuser 218 between protective caps 204.

Figure 19:
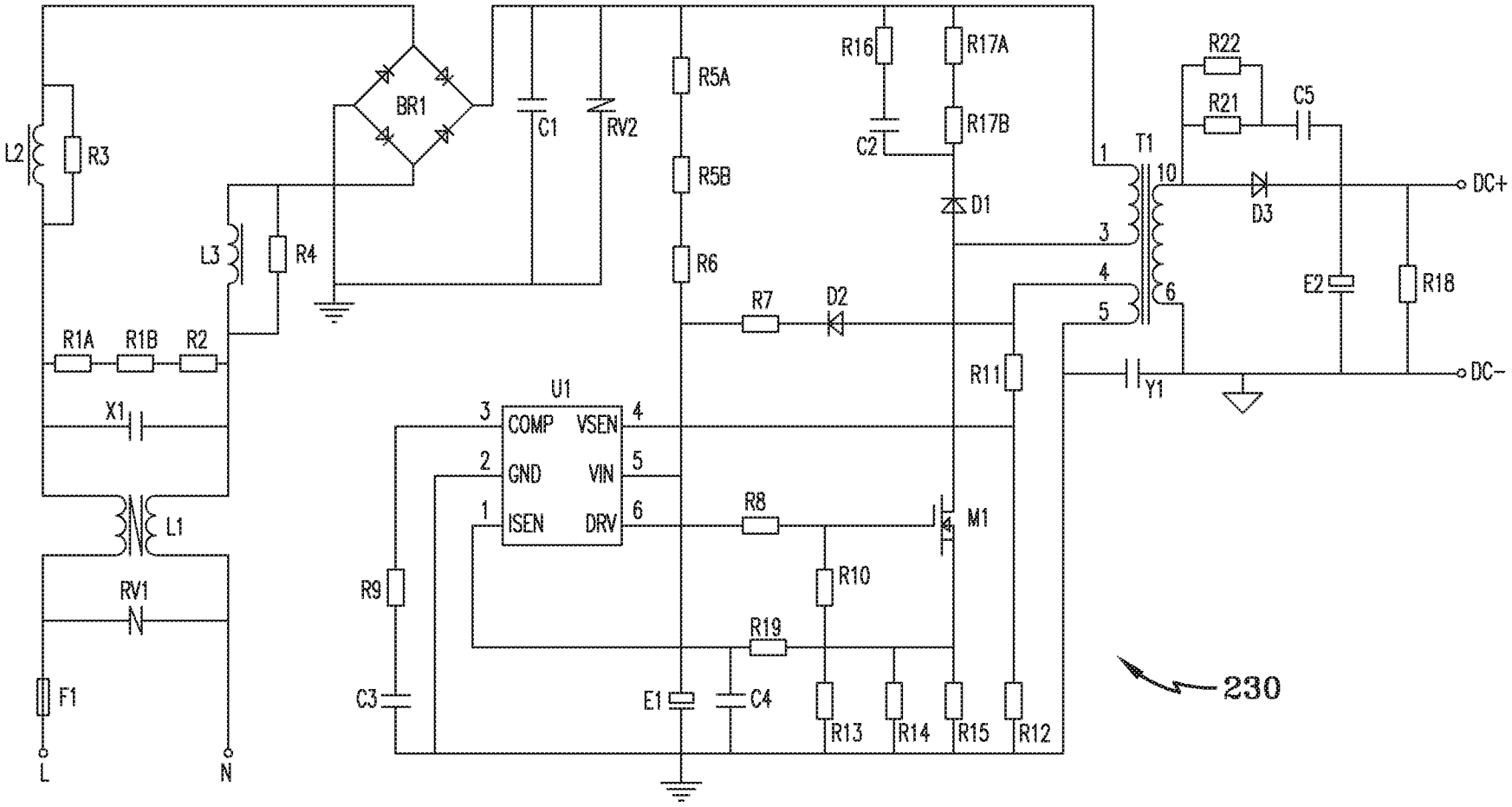
FIG. 19 is an electric circuit diagram of the electrical components included in the linkable LED strip lighting fixture shown in FIGS. 10-13.

Referring next to FIG. 19, a circuit 230 is shown for the electric circuitry of linkable LED strip light fixtures 150 and 190. Circuit 230 includes inputs L and N, a fuse F1 connected in parallel with a voltage variator RV1, and the latter are connected to a variable inductor L1. These are connected to a circuit for output smoothing, which includes a capacitor x1, resistors R1A, R1B and R2, the latter of which are connected in series and in parallel with capacitor X1. Also included in the smoothing circuit are resistor R3 which is connected across inductor L2 and resistor R4 which is connected across inductor L3. Included in the smoothing circuit is a diode bridge BR1. BR1 is connected in parallel with a capacitor C1 and a variable capacitor RV2. Another circuit connected to the previously discussed circuits includes three resistors R5A, R5B and R6 which connected in series, and in parallel with a diode D2 and a resistor R7. Further in the latter circuit are a resistor R16 connected in series with a capacitor C2, connected in parallel with resistors R17A and R17B, the latter connected in series. A transformer T1 is connected across the latter circuit including diode D1 and another circuit having a positive direct current and negative direct current terminals. Lines 4 and 5 which are connected to transformer T1 run in parallel and resistors R11 and R12 are connected in line 4. Between the line connecting R11 and R12 is a line connected across a control circuit U1. A semiconductor control component M1 is connected in parallel with resistors R10 and R19, and in parallel with parallel conductors R13, R14 and R15 as well as capacitor C4.

Figure 21:
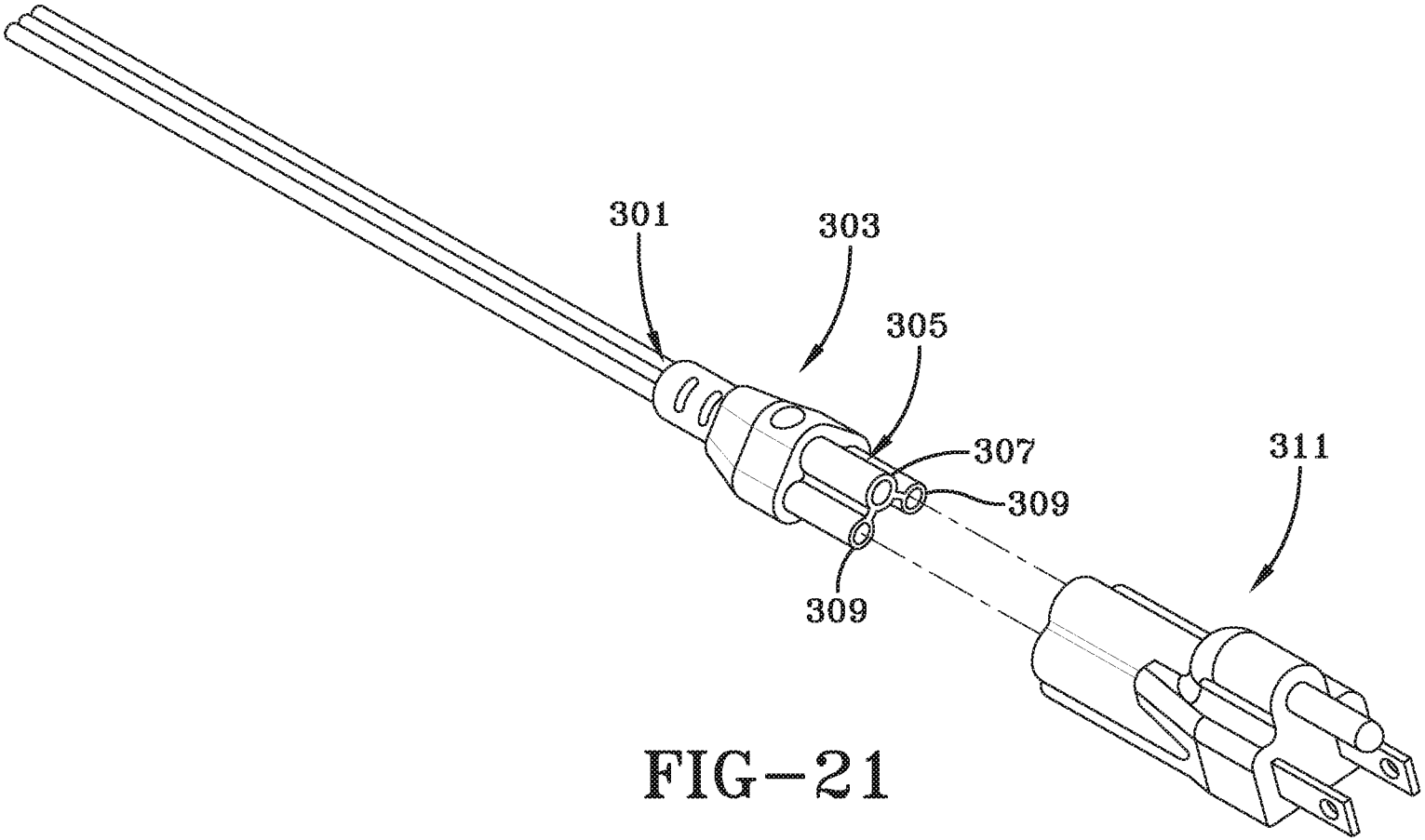
FIG. 21 is a perspective view of a linking cable and a patch plug according to the preferred embodiment of another aspect of the present invention.

Linking cables 63 and 224, linking connectors 53 and 222, and power cables 61 and 226 have been described above. A variation renders a power cable unnecessary. Reference is first made to FIG. 21. A linking cable or linking cord 301 is shown. Linking cable 301 is essentially the same as linking cable or linking cord 63, or linking cable or linking cord 224. It has been found to be advantageous for linking cable 301 to be about five feet in length. Linking cable 301 includes at its opposite ends a linking plug 303 (only 1 is shown) similar or identical to input plug 69, linking plugs 70 and the corresponding plugs on linking cable 24 and power cable 226. Linking plug 303 is constructed virtually identically with input plug 69, linking plugs 70 and the corresponding plugs on linking cable 22 and power cable 226. Thus, linking plug 303 has linking electricity transmitting structure 305 depicted in this embodiment as including a relatively large female tubular connector 307, and two other relatively small but equal-sized tubular connectors 309. Connectors 307, 309 have copper or other electrically conductive linings that are connected to the respective conductive wires in linking cable 301.

Figure 22:
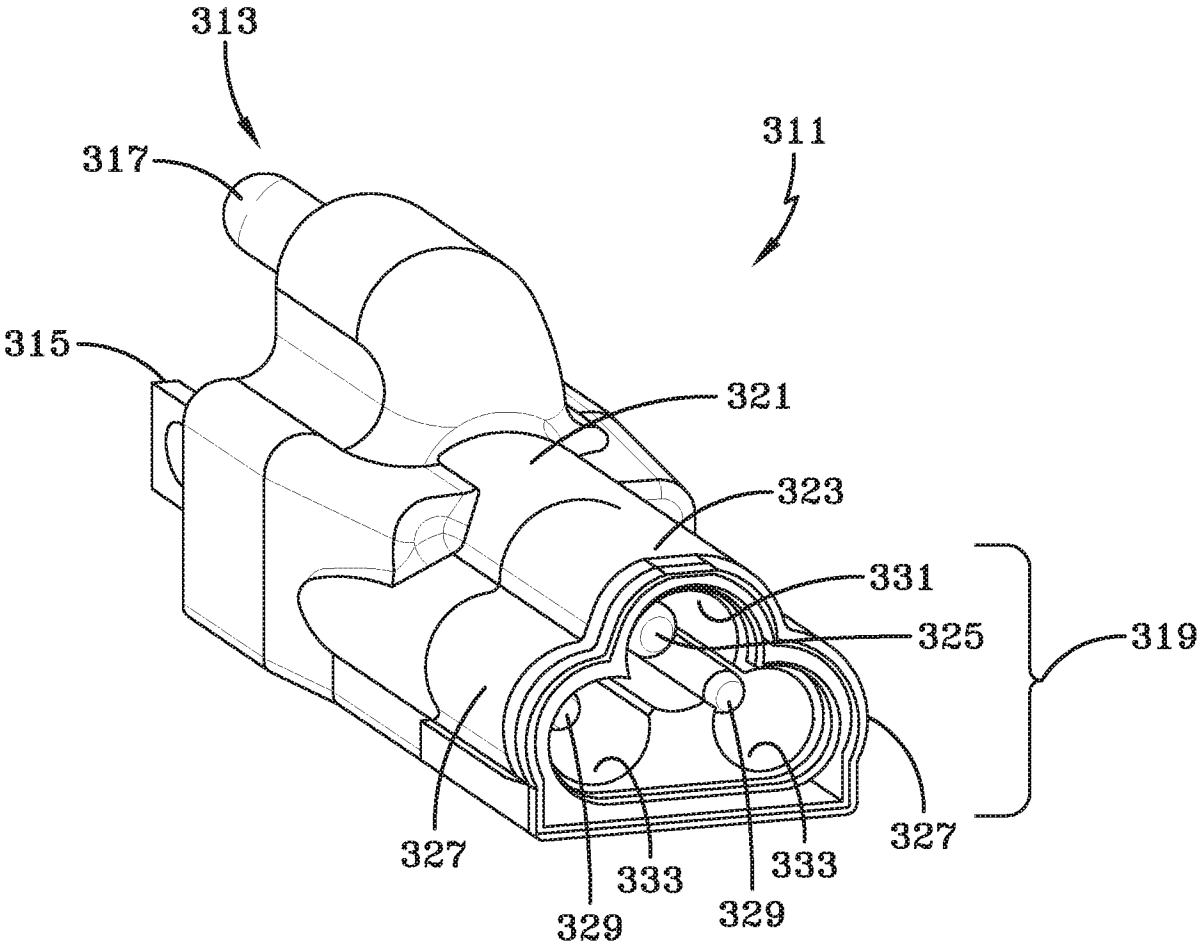
FIG. 22 is a perspective view of one end of the patch plug shown in FIG. 21.
Figure 23:
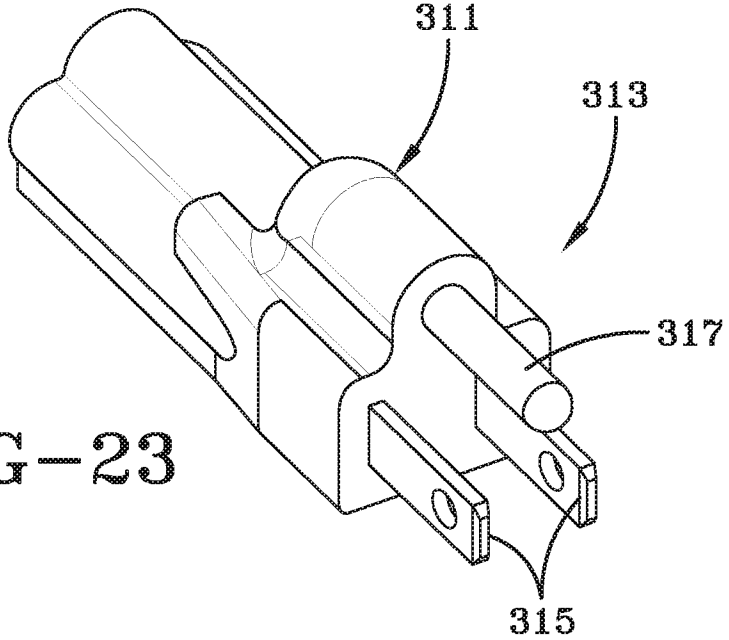
FIG. 23 is a perspective view of the opposite end of the patch plug shown in FIG. 21.

When two LED linkable lighting fixtures such as LED shop lighting fixture 101, LED strip lighting fixtures 153 or LED strip lighting fixture 190 are to be linked together, an insulated cable is placed between the two fixtures and linking plug 303 from either end of the cable is inserted into the appropriate connection such as end cap assembly 7 in LED shop light engine 3, linking opening 155 in LED strip lighting fixture 153 or connecting seat 200 in linkable LED strip lighting fixture 190. However, when electrical power is to be transmitted to the LED linkable lighting fixture as described above, a pitch plug 311 according to an aspect of the present invention is employed. Referring to FIGS. 22 and 23, patch plug 311 is a one-piece unit, and includes at one end a power plug 313 that includes a pair of input prongs 315 and a grounding prong 317. At the other end of patch plug 311 is a male plug 319 which is connected to power plug 313 by a middle injection part 321 (assuming patch plug 31 is made from an appropriate plastic).

Male plug 319 is composed of three merged tubes composed of a relatively large, non-electrical conducting cylindrical tube 323 having an axially extending contact pin 325, and linking electricity transmitting structure. The latter is in the form of a pair smaller and equal non-conducting cylindrical tubes 327. Tubes 323, 325 and 327 are part of a composite unit in the form of a trefoil. Each of tubes 327 has an axially extending contact pin 329. Cylindrical tube 323 has an internal, cylindrical plastic shield 331, and merged cylindrical tubes 327 have internal, cylindrical plastic shields 333. When electrical power is to be supplied to one or more LED linkable lighting fixtures as described above, male plug 319 receives connector 305, with connector 307 being inserted into tube 323 and connectors 309 being inserted into respective tubes 327 of male plug 319. Power plug 313 is inserted into a three prong receptacle of an electrical outlet which are in common use.

The embodiments of the invention described above provide very useful and economical lighting systems which can be used to illuminate different areas according to their respective sizes and shapes. The respective linkable LED lighting fixtures can be easily linked together by persons without needing any training to make these connections. With respect to a series of linkable LED shop lighting fixtures, the LED shop lighting fixtures can be placed in virtually any space and pointed in any direction, linked together and plugged into a wall output. Similarly, linkable LED strip lighting fixtures can be linked together and be connected to a power outlet with a power cord. The respective LED light units can be connected together by a linking cable of any length, and which is flexible so that the respective lighting units can face in virtually any direction. Similarly, the linkable LED lighting fixtures can be connected together by rigid connector to render lighting fixtures to be in effect a single lighting unit having various lengths, with the individual components being individually operated. Electrical circuitry can be provided for operating the linked LED lighting fixtures simultaneously. The invention could be used on many LED lighting devices such as cabinet lighting The invention has been described in detail, with particular emphases on the preferred embodiments thereof, but variations and modifications may occur to those skilled in the art to which the invention pertains.

The invention claimed is:

1. The combination of a linking apparatus and a linkable LED strip lighting fixture for being electrically linked to another linkable LED strip lighting fixture;

wherein said linking apparatus comprises:

an insulated cable line having insulated cable line end portions;

a linkable LED connection device at each of said insulated cable line end positions; and a patch plug comprising:

a linkable LED connection device receptacle for receiving one of said linkable LED connection devices of said linking apparatus; and an outlet plug for insertion into an electric outlet for transmitting electrical current through said patch plug, through said linking device and into said linkable LED strip lighting fixture;

wherein said linkable LED lighting fixture comprises:

an LED light engine including:

an LED module comprising at least two flexible strips of LEDs;

a driver electrically connected to said LED module;

a heat sink for absorbing heat from said LED module; and a diffuser; and an LED light engine electrical contacting structure electrically operatively connected to said LED module, said LED light engine electrical contacting structures each comprising an access for one of said linkable LED connection device for transmitting electrical current to said LED module;

said LED light engine being activatable in response to said access receiving one of said linkable LED connection devices.

2. The combination of a linking apparatus and a linkable LED strip lighting fixture according to claim 1 wherein said linkable LED strip lighting fixture is an elongated, linkable LED strip lighting fixture, and wherein:

said LED light engine is an elongated LED strip light engine;

said LED module comprises at least two flexible strips of LEDs, and wherein said LED module is elongated and has a predetermined length;

said driver electronically connected to said LED module;

said heat sink is elongated, is of substantially the same length as said LED module and is parallel to said LED module; and said diffuser is elongated, is substantially the same length and is parallel to each of said LED module and said heat sink.

3. An elongated linkable LED strip lighting fixture for use with a linking device, the linking device comprising electricity transmitting plugs, said elongated linkable LED lighting fixture comprising:

a housing comprising:

a shade including:

a rectangular top wall including a relatively short width with opposing straight parallel end edges and parallel opposing straight side edges;

a pair of identical opposing rectangular side walls having a first pair of opposing parallel side edges connected to said opposing straight parallel end edges of said rectangular top wall, and a second pair of opposing parallel side edges spaced from said first pair of opposing parallel side edges, said rectangular top wall and said pair of identical opposing rectangular side walls forming a three sided cavity having opposing end edges, each of said opposing end edge having a flat upper edge connecting two, opposing parallel side edges to form a respective open end;

a pair of opposing identical end pieces, each end piece comprising a plate dimensioned to fit across said end edges of said top wall and said side walls;

a linkable elongated LED strip light engine having opposite end portions and a longitudinal axis, said elongated LED strip light engine, including:

an elongated LED module comprising at least two flexible strips of LEDs a printed circuit board; and an array of electrically connected LEDs attached to said printed circuit board, said array of electronically connected LEDs including:

at least two strips of LEDs, each strip of LEDs including LEDs electrically connected to each other in parallel; and a driver operatively connected to said strips of LEDs and electrically connectable to a power source for transmitting electric current to said LED module in a form usable by said LED module;

said at least two flexible strips of LEDs and said driver being electrically connectable as part of an electrical circuit;

a heat sink spaced from and extending along said elongated LED module for absorbing heat generated by said array of electronically connected LEDs;

an elongated diffuser for partially surrounding said elongated LED module for diffusing illumination emitted by said LEDs, said elongated diffuser having opposite ends;

end covers at said opposite ends of said diffuser;

a pair of connecting seats each having a shape;

wherein said end pieces have apertures for receiving said respective connecting seats and said respective connecting seats being shaped for reception in said apertures, said connecting seats each having a linking plug receiving opening and electrical lines for establishing an electrical connection between said respective linking plug receiving opening and said strip light engine;

a linking cable for selectively electrically linking a pair of said elongated, linkable LED strip light engines together, said linking cable comprising:

an insulated linking cable line having opposite linking cable ends; and identical linking plugs electrically connected to said linking cable line;

wherein said linking plug receiving openings of said connecting seats and said respective linking plugs are each trefoiled shaped; and said linking plug receiving openings in said connecting seats are configured as receptors for said respective trefoiled shaped linking plugs in a cooperative relationship;

wherein said elongated, linkable LED shop lighting fixtures when electrically linked together are selectively actuable to turn the respective elongated, linkable LED strip light engines on or off independently of the remaining elongated, linkable LED strip light engines.

4. The linkable LED strip lighting fixture according to claim 3 wherein:

said rectangular top wall, said opposing rectangular side walls and said opposing opposing identical end pieces define a cavity, said LED strip light engine being located in said cavity.

5. The linkable LED strip lighting fixture according to claim 3 wherein said linkable LED strip lighting fixture has a switch for selectively turning said linkable LED strip lighting fixture on and off without affecting any other linkable LED strip lighting fixture linked to said linkable LED strip lighting fixture.

6. An elongated, linkable LED strip lighting fixture according to claim 3, and further comprising:

a power cable comprising:

an electricity transmitting line having opposite line ends;

an outlet plug operatively connected to one of said line ends, said outlet plug having plug prongs for insertion into an electric power outlet; and an electrical linking plug operatively connected to the other of said line ends, said electrical linking plug having a trefoil configuration corresponding to the trefoil shape of said connecting seats, said linking plug receiving openings in said connecting seats are configured as receptors for said trefoiled shaped linking plug in a cooperative relationship.

7. A combination of a linking apparatus and a linkable LED strip lighting fixture for being electrically linked to another linkable LED strip lighting fixture;

wherein said linking apparatus comprises:

an insulated cable line having insulated cable line end portions; and a linkable LED connection device at each of said insulated cable line end positions;

a patch plug comprising:

a linkable LED connection device receptacle for receiving one of said linkable LED connection devices of said linking apparatus; and an outlet plug for insertion into an electric outlet for transmitting electrical current through said patch plug, through said linking device and into said linkable LED strip lighting fixture; and wherein said linkable LED strip lighting fixture comprises:

an LED strip light engine including:

an LED module;

a driver electrically connected to said LED module;

a heat sink for absorbing heat from said LED module; and a diffuser; and an LED strip light engine electrical contacting structure electrically operatively connected to said LED module, said LED strip light engine electrical contacting structures each comprising an access for one of said linkable LED connection device for transmitting electrical current to said LED module;

said LED strip light engine being activatable in response to said access receiving one of said linkable LED connection devices.

8. The combination of a linking apparatus and a linkable LED strip lighting fixture according to claim 7 wherein said linkable LED strip lighting fixture is an elongated, linkable LED strip lighting fixture, and wherein:

said LED strip light engine of said linkable LED strip lighting fixture is an elongated LED strip light engine.

9. The combination of a linking apparatus and a linkable LED strip lighting fixture according to claim 7 wherein said linkable LED strip lighting fixture is an elongated, linkable LED strip lighting fixture, and wherein:

said LED strip light engine of said linkable LED strip lighting fixture is an elongated LED strip light engine.

10. The linkable LED strip lighting fixture according to claim 7 wherein said linkable LED strip lighting fixture comprises a switch for selectively turning said linkable LED strip lighting fixture on and off without affecting any other linking LED strip lighting fixtures linked to said linkable LED strip lighting fixture.

11. The linkable LED strip lighting fixture according to claim 7 and further comprising a protective cap for selectively closing said respective accesses.

12. The linkable LED strip lighting fixture according to claim 7 wherein said linkable LED strip lighting fixture is a linkable, elongated LED strip lighting fixture, and wherein:

said housing comprises:

a shade including:

a rectangular top wall including a relatively short width with opposing straight parallel end edges and parallel opposing straight side edges;

a pair of identical opposing rectangular side walls having a first pair of opposing parallel side edges connected to said opposing straight parallel end edges of said rectangular top wall, and a second pair of opposing parallel side edges spaced from said first pair of opposing parallel side edges, said rectangular top wall and said pair of identical opposing rectangular side walls forming a three sided cavity having opposing end edges, each of said opposing end edge having a flat upper edge connecting two, opposing parallel side edges to form a respective open end; and a pair of opposing identical end pieces, each of said opposing identical end pieces comprising a plate dimensioned to fit across said end edges of said top wall and said side walls;

wherein said LED strip light engine is a, linkable, elongated LED strip light engine having opposite end portions and a longitudinal axis, said linkable, elongated LED strip light engine comprising:

an elongated module having a predetermined length and including:

at least two flexible strips of LEDs, each of said at two flexible strips of LEDs including LEDs electrically connected to each other in parallel;

a driver operatively connected to said elongated module and electrically connectable to a power source; and said elongated module and said driver being electrically connectable as part of an electrical circuit;

an elongated heat sink spaced from and extending along said elongated LED module for absorbing heat generated by said LEDs;

an elongated diffuser for partially surrounding said elongated LED module for diffusing illumination emitted by said LEDs, said elongated diffuser having opposite ends;

end covers at said opposite ends of said diffuser;

a pair of connecting seats each having a shape;

wherein said end pieces have apertures for receiving said respective connecting seats and said respective connecting seats being shaped for reception in said apertures, said connecting seats each having a linking plug receiving opening and electrical lines for establishing an electrical connection between said respective linking plug receiving opening and said linkable, elongated LED strip light engine;

a linking cable for selectively electrically linking a pair of said linkable, elongated LED strip lighting fixtures together, said linking cable comprising:

an insulated linking cable line having opposite linking cable ends; and identical linking plugs electrically connected to said linking cable line;

wherein said linking plug receiving openings of said connecting seats and said respective linking plugs are each trefoiled shaped; and said linking plug receiving openings in said connecting seats are configured as receptors for said respective trefoiled shaped linking plugs in a cooperative relationship;

wherein said linkable, elongated LED shop lighting fixtures when electrically linked together are selectively actuable to turn the respective linkable, elongated LED strip light engines on or off independently of the remaining linkable, elongated LED strip light engines.

13. A linkable, elongated LED strip lighting fixture for use with a linking device, the linking device comprising electricity transmitting plugs, said linkable, elongated LED strip lighting fixture comprising:

a housing comprising:

an elongated shade including:

a rectangular top wall including a relatively short width with opposing, straight, parallel end edges and parallel opposing straight side edges;

a pair of identical opposing, parallel, rectangular side walls having a first pair of opposing, parallel side edges connected to said opposing, straight, parallel end edges of said rectangular top wall, and a second pair of opposing, parallel side edges spaced from said first pair of opposing, parallel side edges, said rectangular top wall and said pair of identical, opposing, parallel, rectangular side walls forming a three sided cavity having opposing end edges, each of said opposing end edge having a flat upper edge connecting two, opposing parallel side edges to form a respective open end;

a pair of opposing identical end pieces, each end piece comprising a plate dimensioned to fit across said end edges of said top wall and said side walls;

a linkable, elongated LED strip light engine having opposite end portions and a longitudinal axis, said linkable, elongated LED strip light engine including:

an elongated LED module comprising:

an electric circuit including:

a printed circuit board; and an array of electrically connected LEDs attached to said printed circuit board, said array of electrically connected LEDs including:

at least two flexible strips of LEDs, each of said at least two flexible strips of LEDs including LEDs electrically connected to each other in parallel; and a driver operatively connected to said at least two strips of LEDs and being electrically connectable to a power source for transmitting electric current to said elongated LED module in a form usable by said elongated LED module;

a heat sink spaced from and extending along said elongated LED module for absorbing heat generated by said at least two flexible strips of LEDs;

an elongated diffuser for partially surrounding said elongated LED module for diffusing illumination emitted by said at least two flexible strips of LEDs, said elongated diffuser having opposite ends;

end covers at said opposite ends of said diffuser;

a pair of connecting seats each having a predetermined trefoil shape;

wherein said end pieces have apertures for receiving said respective connecting seats and said respective connecting seats comprising a predetermined shape for reception in said apertures, said connecting seats each having a linking plug receiving opening and electrical lines for establishing an electrical connection between said respective linking plug receiving opening and said linkable elongated LED strip light engine;

a linking cable for selectively electrically linking a pair of said linkable LED strip light engines together, said linking cable comprising:

an insulated linking cable line having opposite linking cable ends; and identical linking plugs electrically connected to said linking cable line;

wherein said linking plug receiving openings of said connecting seats and said respective linking plugs each have said predetermined trefoil shape; and said linking plug receiving openings in said connecting seats are configured as receptors for said respective trefoiled shaped linking plugs in a cooperative relationship;

wherein said linkable, elongated LED shop lighting fixtures when electrically linked together are selectively actuable to turn the respective linkable, elongated LED strip light engines on or off independently of the remaining linkable, elongated LED strip light engine; and LED light engine electrical contacting structures electrically connected to said LED module, said LED light engine electrical contacting structures each comprising an access for reception of an electricity transmitting plug;

wherein two of said linkable LED strip lighting fixtures are electrically linkable together in response to the reception of electricity transmitting plugs from the linking device in said respective accesses.

14. The linkable, elongated LED strip lighting fixture according to claim 13 wherein:

said rectangular top wall is an elongated rectangular top wall; and said opposing rectangular side walls are elongated;

wherein said linkable, elongated LED light engine further comprises:

said electric circuit; and a circuit switch having a closed position for closing said electric circuit and an open position for opening said electric circuit.

15. The linkable, elongated LED strip lighting fixture according to claim 13 wherein said linkable, elongated LED strip light engine further comprises opposite LED light engine end portions, and wherein said LED light engine electrical contacting structures are in operative relationship with said opposite LED light engine end portions.

16. The linkable LED strip lighting fixture according to claim 13 wherein said electricity transmitting plugs of the linking device are a set of electrically insulated tubes having electrical conducting sleeves; and wherein said LED light engine electrical contacting structures each comprise a set of insulating cylinders having internal axial electrical conductors tubes for each receiving an electrically insulated tube for making electrical contact with the electrical conducting sleeve to enable transmission of electrical current between the conducting tube and said electrically conducting sleeve.

* * * * *